US007926426B2

(12) United States Patent
Sperling

(10) Patent No.: US 7,926,426 B2
(45) Date of Patent: Apr. 19, 2011

(54) RAILWAY SCRAP RECOVERY VEHICLE

(75) Inventor: Fred S. Sperling, Canton, OH (US)

(73) Assignee: Sperling Railway Services, Inc., Canton, OH (US)

( * ) Notice: Subject to any disclaimer, the term of this patent is extended or adjusted under 35 U.S.C. 154(b) by 411 days.

(21) Appl. No.: 12/011,799

(22) Filed: Jan. 30, 2008

(65) Prior Publication Data

US 2009/0188406 A1 Jul. 30, 2009

(51) Int. Cl.
*E01B 29/00* (2006.01)
*E01B 29/32* (2006.01)
*E01B 27/06* (2006.01)

(52) U.S. Cl. ..... 104/279; 104/2; 105/72.2

(58) Field of Classification Search ..... 104/16, 104/279, 307, 2, 72.2, 215.2; 105/72.2, 215.2
See application file for complete search history.

(56) References Cited

U.S. PATENT DOCUMENTS 3,690,264 A 9/1972 Plasser et al.
3,731,455 A 5/1973 Theurer
4,178,236 A 12/1979 Theurer
4,178,237 A 12/1979 Theurer
4,225,429 A 9/1980 Holley
4,263,797 A 4/1981 Cooper
4,478,152 A 10/1984 Holley
4,691,639 A * 9/1987 Holley ..... 104/16
4,722,283 A 2/1988 Holley
4,921,732 A * 5/1990 Bounds ..... 427/325
4,940,001 A 7/1990 Holley
5,331,899 A 7/1994 Holley
5,571,406 A * 11/1996 Mensching ..... 210/159
5,657,700 A * 8/1997 Bounds ..... 105/311.1
7,244,089 B2 7/2007 Sperling

* cited by examiner

*Primary Examiner* — S. Joseph Morano
*Assistant Examiner* — Zachary Kuhfuss
(74) *Attorney, Agent, or Firm* — Sand & Sebolt

(57) ABSTRACT

A railway vehicle recovers metallic objects like railroad spikes from a railway bed having a pair of rails. The vehicle includes wheels for riding on each rail and a carriage carrying a crawler for supporting the vehicle on the railway bed when one of the rails is removed. A pneumatic lift raises and lowers the carriage and crawler. A conveyor belt assembly for transporting the metallic objects to a hopper is supported entirely by an overhead support structure. A lateral translator moves the conveyor belt assembly from side to side. Various features are provided which allow a conveyor belt to be removed from one side of the conveyor belt assembly while maintaining continuity of the conveyor belt loop. A distinctive conveyor lift is provided for raising and lowering the conveyor belt assembly. A remote control is provided for controlling various operations of the vehicle.

44 Claims, 28 Drawing Sheets

RAILWAY SCRAP RECOVERY VEHICLE

BACKGROUND OF THE INVENTION

1. Technical Field

The present invention relates generally to a vehicle which travels on railway tracks to remove metallic objects such as tie plates and railroad spikes from a railway bed. More particularly, the invention relates to various improvements to the vehicle, including a pneumatic crawler lift and suspension system, and a conveyor lift and a lateral movement drive assembly, and a remote control for controlling various operations of the vehicle.

2. Background Information

Railroad tracks are in constant need of repair or replacement and thus accumulate various metallic objects along the railway bed during the removal and replacement of various components making up the tracks. Vehicles which ride on the railroad track rails and on the railway bed for removing these various metallic objects are well known in the art. However, there is a need for various improvements on these vehicles.

These vehicles are specifically designed to either ride on a pair of rails of the railroad track when both rails are in place, or to ride on one of the rails and on the railway bed when the other of the rails is removed to facilitate repair of the tracks. Crawlers which are known in the art contact the railway bed along one side of the vehicle to support the vehicle while the standard railway wheels are seated on the rail which remains in place so that the vehicle rolls along the rail that is in place while the crawlers move along the railway bed. The crawlers are moveable from a lowered position in which they contact the railway bed to a raised position out of contact with the railway bed when they are not needed. While the crawlers that are known in the industry are suited for their purpose, there is still room for improvement in this area.

In addition, conveyor belt assemblies are known which utilize a magnetic drum or roller at one end around which the conveyor belt revolves in order to magnetically pick up various metallic objects off the railway bed and carry them to a hopper on the vehicle. The end of the conveyor belt assembly on which the magnetic drum is mounted is typically moveable between a lowered position during operation and a raised position when not in use. At least one patent (U.S. Pat. No. 4,225,429 granted to Holley) discloses the ability to move the conveyor belt assembly laterally from one side of the vehicle to the other so that it may be positioned along various regions of the railway bed. However, there is also a need in the art for improvement in the mechanisms used for raising and lowering the conveyor belt assembly as well as for moving it laterally. In addition, the controls for operating standard vehicles of this nature are disposed on the vehicle typically within a cab mounted thereon. This requires that the operator stand or sit on the vehicle while manipulating the various controls. For certain aspects of operation, this requirement may limit the operator's ability to visually verify the movement of various components of the vehicle relative to the railway bed and may also put the operator or others at risk of injury. Thus, there is a need in the art for a remotely controlled vehicle. The present application addresses the above-mentioned problems in the art in addition to various other matters.

BRIEF SUMMARY OF THE INVENTION

The present invention provides an apparatus for traveling along a railway bed having first and second railroad rails, the apparatus comprising: a frame; a first set of rail engaging wheels mounted on the frame and adapted to ride on the first rail; a second set of rail engaging wheels mounted on the frame and adapted to ride on the second rail; a crawler adapted to support the frame for travel along the railway bed when one of the rails is removed from the railway bed; a carriage which carries the crawler; a lowered position of the carriage in which the crawler is adapted to contact the railway bed; a raised position of the carriage in which the crawler is adapted to be out of contact with the railway bed; and a first pneumatic lift mounted on the frame for raising the carriage from the lowered position to the raised position.

The present invention also provides an apparatus for traveling along a railway bed having first and second railroad rails, the apparatus comprising: a frame; a first set of rail engaging wheels mounted on the frame and adapted to ride on the first rail; a second set of rail engaging wheels mounted on the frame and adapted to ride on the second rail; a crawler; a carriage which carries the crawler; a lowered position of the carriage in which the crawler is adapted to contact the railway bed; a raised position of the carriage in which the crawler is adapted to be out of contact with the railway bed; and a sliding engagement between the carriage and the frame during movement between the lowered and raised positions.

The present invention further provides An apparatus for traveling along a railway bed having first and second railroad rails, the apparatus comprising: a frame; a first set of rail engaging wheels mounted on the frame and adapted to ride on the first rail; a second set of rail engaging wheels mounted on the frame and adapted to ride on the second rail; a crawler; a carriage which carries the crawler; a lowered position of the carriage in which the crawler is adapted to contact the railway bed; a raised position of the carriage in which the crawler is adapted to be out of contact with the railway bed; a roller on one of the carriage and the frame; and a rolling engagement between the roller and the other of the carriage and frame during movement between the lowered and raised positions.

BRIEF DESCRIPTION OF THE SEVERAL VIEWS OF THE DRAWINGS

Similar numbers refer to similar parts throughout the drawings.

DETAILED DESCRIPTION OF THE INVENTION

Figure 1:
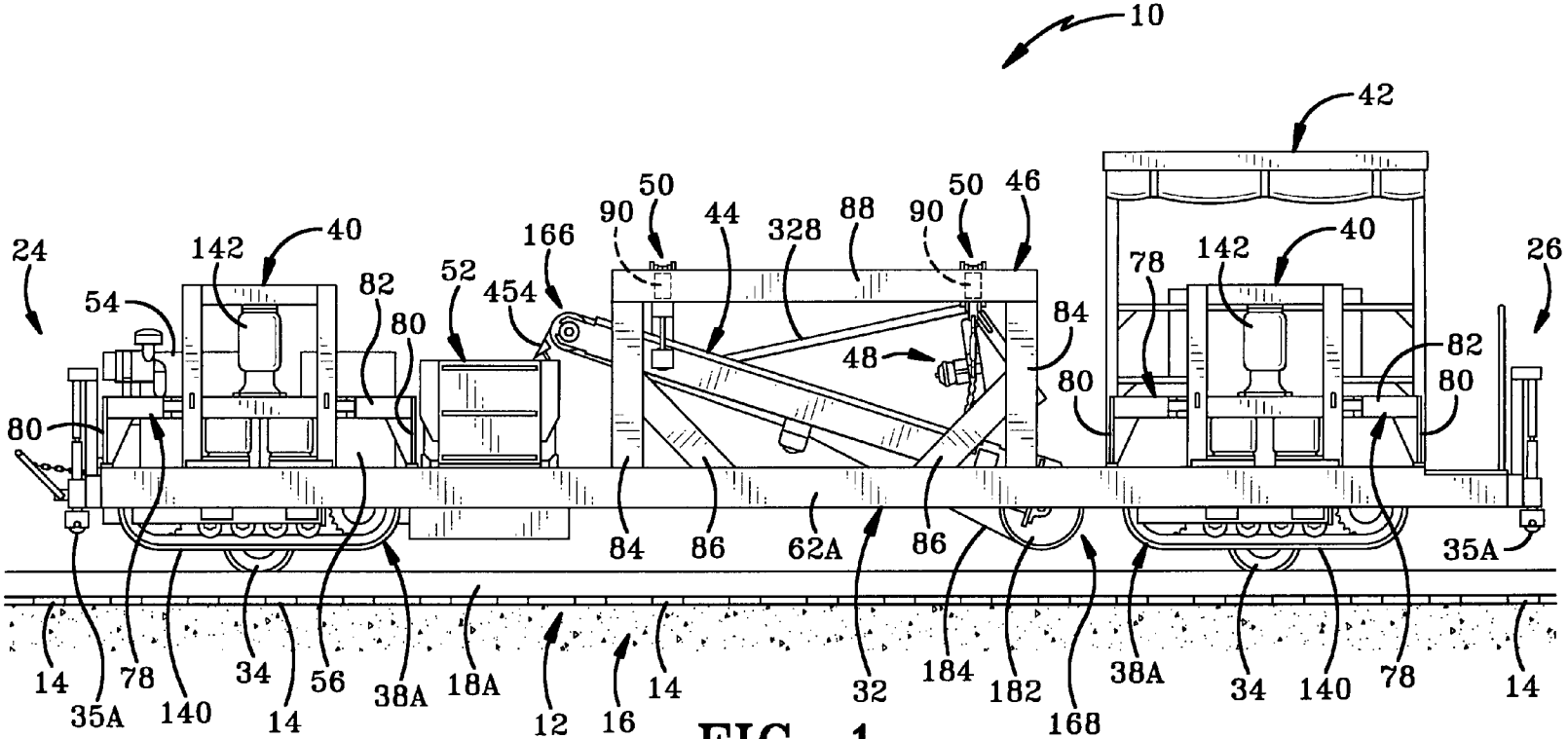
FIG. 1 is a side elevational view of the vehicle of the present invention taken from its left side and shown riding on a pair of railroad track rails.
Figure 2:
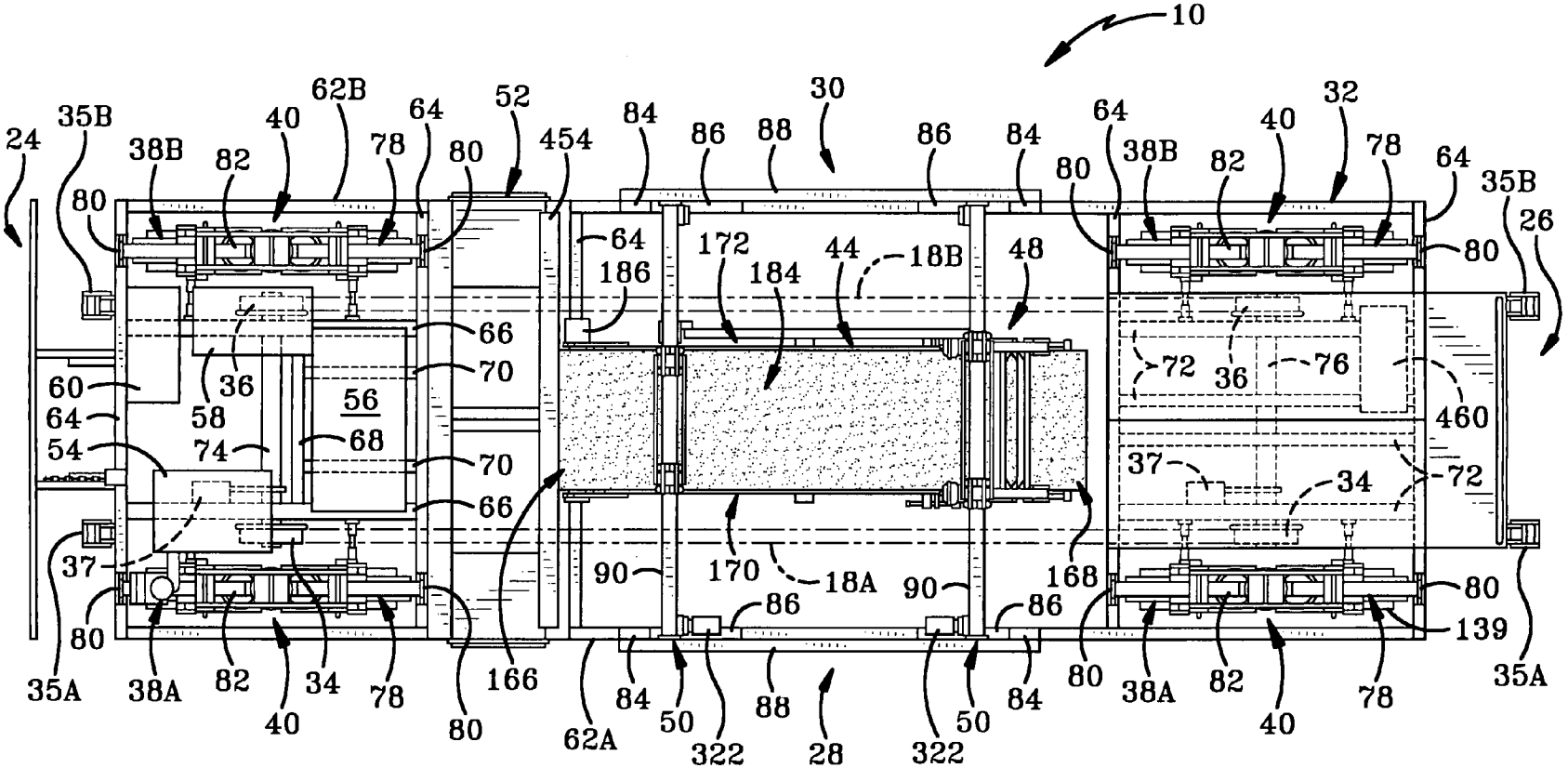
FIG. 2 is a top plan view of the vehicle.

The railway scrap recovery vehicle of the present invention is indicated generally at 10 in FIGS. 1 and 2. Vehicle 10 is configured to travel along a railroad track or railway bed 12 which comprises numerous wooden ties 14 which are embedded in the ground or gravel bed 16 with a pair of rails 18A and 18B secured to ties 14. More particularly, vehicle 10 travels along railway bed 12 in order to magnetically pick up metallic objects such as tie plates 20 and railroad spikes 22 (FIGS. 18-19) from railway bed 12 after one of rails 18 has been removed from bed 12. More particularly, each rail 18 is seated atop a plurality of tie plates 20 and secured to tie plates 20 and ties 14 via spikes 22 which extend through holes in plates 20 and into ties 14. Thus, when spikes 22 are removed from ties 14 and the plates 20 which support a given rail 18, said rail 18 may be removed from railway bed 12 in order to allow for repair or replacement of the various components such as rails 18, plates 20, spikes 22 and anchors (not shown) which clip to the base of the rail and bear against the tie to prevent thermal expansion and contraction.

With continued reference to FIGS. 1 and 2, vehicle 10 has a front 24 and a rear 26 defining therebetween a longitudinal direction of the vehicle which is also the direction in which the vehicle travels. Vehicle 10 also has first and second or left and right sides 28 and 30 defining therebetween an axial direction of vehicle 10. Vehicle 10 includes a rigid frame 32 typically formed of metal and carried in one configuration or mode by first set of longitudinally spaced rail-engaging wheels 34 and a second set of longitudinally spaced rail-engaging wheels 36 which are axially spaced from wheels 34. Wheels 34 are configured to roll along rail 18A while wheels 36 are configured to roll along rail 18B during travel of vehicle 10 along said rails. More particularly, each of wheels 34 and 36 has a main wheel portion which rides on the top of the respective rails 18 and a circular flange having a diameter greater than that of the main wheel portion so that it extends downwardly closely adjacent or abutting one side of the respective rail 18. Guide wheel assemblies are also mounted on frame 32 and include a set of front and rear guide wheels 35A and a set of front and rear guide wheels 35B which are axially spaced from guide wheels 35A. Each guide wheel assembly includes a hydraulic actuator for raising and lowering the respective guide wheel 35 so that guide wheels 35A in their lowered position are configured to ride along rail 18A and guide wheels 35B in their lowered position are configured to ride along rail 18B. Each guide wheel 35, like rail-engaging wheels 34 and 36, has a main wheel portion that rides along the top of the rail and a circular flange having a diameter greater than the main wheel portion which extends downwardly closely adjacent or abutting the side of the rail opposite the circular flanges of the corresponding wheels 34 or 36. A pair of hydraulic drive motors 37 drives forward and reverse rotation of respective sets of wheels 34 and 36. In addition, a first set of longitudinally spaced crawlers 38A are mounted on frame 32 along first side of 28 while a second set of longitudinally spaced crawlers 38B is mounted on frame 32 along second side 30. Each of crawlers 38 is moveable between a raised position (FIG. 1) out of contact with railway bed 12 and a lowered position (FIG. 8) in contact with bed 12. Thus, when rail 18A, for example, is removed from railway bed 12, left crawlers 38A may be lowered to support frame 32 and various other components of vehicle 10 directly on railway bed 12 while right side 30 remains supported by wheels 36 on rail 18B. Although not shown in the figures, the opposite is also true wherein rail 18B may be removed so that vehicle 10 is support by wheels 34 on rail 18A and crawlers 38B are lowered to engage railway bed 12 and support right side 30 of vehicle 10. Four crawler lift and suspension assemblies 40 are mounted on frame 32 and associated respectively with crawlers 38. An operator cabin 42 is mounted on and extends upwardly from frame 32 between the rear assemblies 40.

Figure 17:
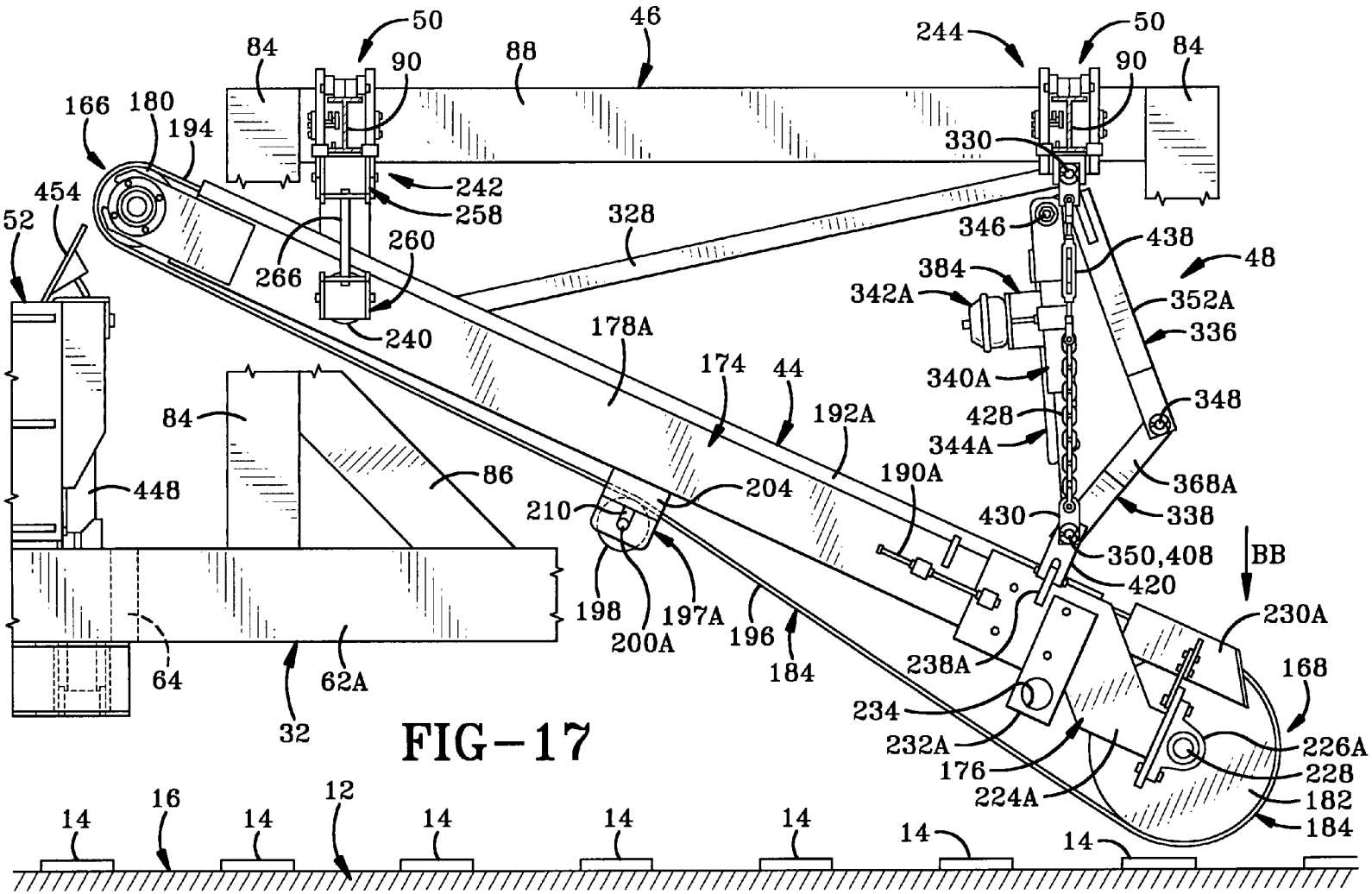
FIG. 17 is similar to FIG. 9 and shows the conveyor belt assembly in its lowered position.
Figure 18:
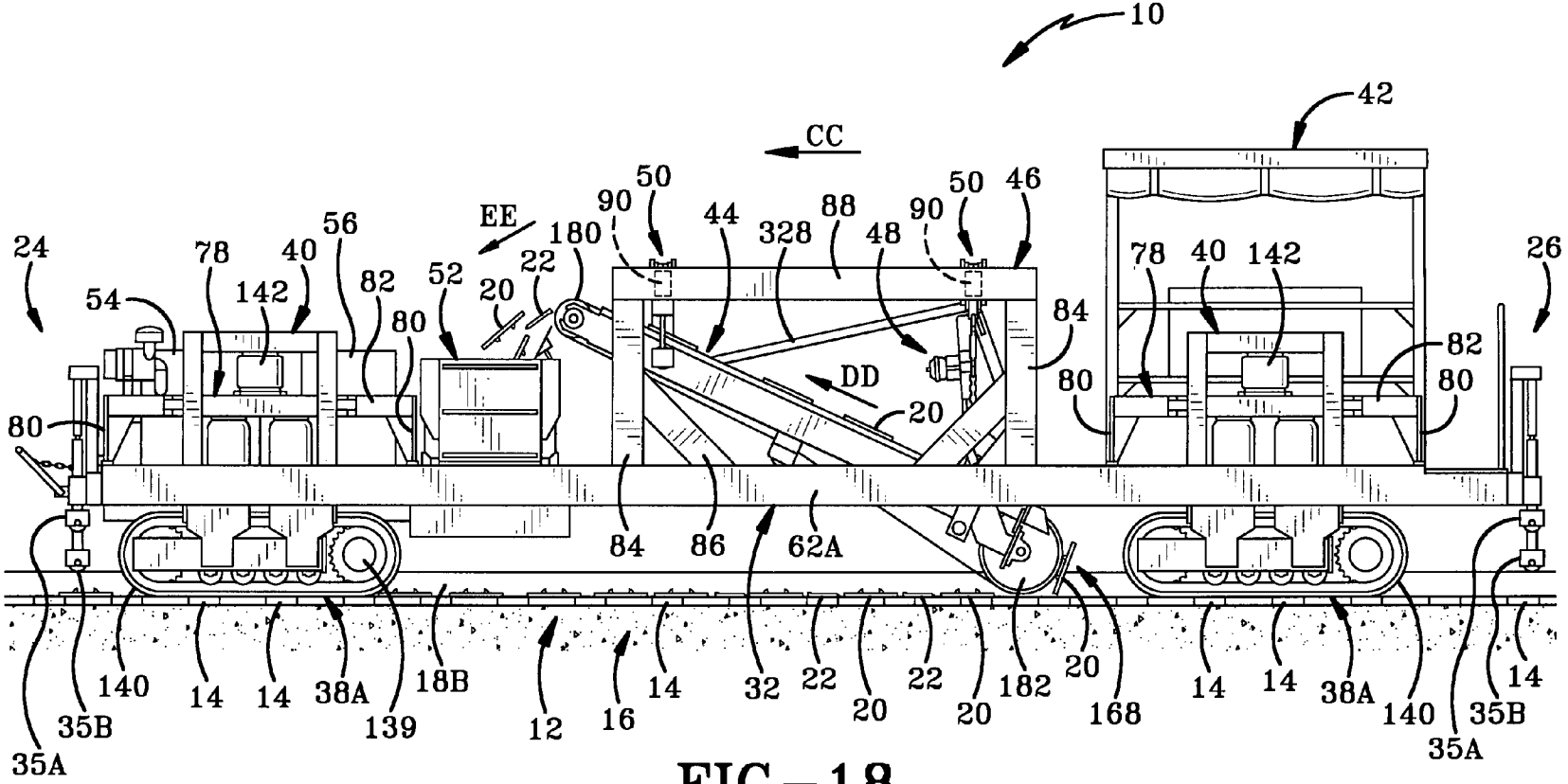
FIG. 18 is similar to FIG. 8 and shows the conveyor belt assembly is its lowered position in operation picking up metallic objects and transporting them to the hopper of the vehicle.

A conveyor belt assembly 44 is mounted on frame 32 forward of cabin 42 and more particularly is suspended from a conveyor suspension structure 46 of frame 32. A conveyor lift 48 is provided for raising and lowering conveyor belt assembly 44 between its raised position (FIG. 1) and lowered position (FIGS. 17 and 18). A lateral translator 50 is mounted on structure 46 to provide lateral or side to side movement of conveyor belt assembly 44, that is, axial movement from a position adjacent first side 28 to adjacent the second side 30. A hopper 52 is mounted on frame 32 forward of conveyor belt assembly 44. Various additional components are mounted on frame 32 forward of hopper 52, including a fuel powered internal combustion engine 54, a hydraulic reservoir and pump 56, a pneumatic reservoir and air compressor 58 and one or more batteries 60. Engine 54 when operated provides power to drive the hydraulic pump and pneumatic compressor while battery 60 facilitates the operation of engine 54 and along with a generator or alternator facilitates the operation of the electrical system of vehicle 10. The hydraulic system includes various hydraulic lines in fluid communication with reservoir and pump 56 and with various components (such as drive motor 37) so that pump 56 may drive operation of the various components. Likewise, the pneumatic system includes various pneumatic valves and lines in communication with reservoir and compressor 58 for driving the operation thereof.

With continued reference to FIGS. 1 and 2, frame 32 is described in greater detail. Frame 32 includes a base structure which comprises left and right primary longitudinal side rails 62A and B which run most of the length of vehicle 10. Several crossbars or axial rails 64 extend axially between and are connected perpendicular to each of side rails 62. In the front suspension area of vehicle 10, the base of frame 32 includes various additional rails including longitudinal rails 66 which extend between and are connected to the front two crossbars 64, a shorter crossbar 68 extending axially between and connected to rails 66 and a pair of shorter longitudinal rails 70 connected to crossbar 68 and extending rearwardly therefrom to the one of crossbars 64. In the rear suspension area of vehicle 10, the base of frame 32 further includes four rear longitudinal rails 72 each extending between and connected to the two rear crossbars 64. A front axle 74 is secured to the base of frame 32 and the front suspension for rotatably mounting the front wheels 34 and 36 thereon and rear axle 76 is mounted on the base of frame 32 in the rear suspension area for rotatably mounting thereon rear wheels 34 and 36. Frame 32 further includes four carriage support structures 78 two of which are adjacent front 24 of vehicle 10 and two of which are adjacent rear 26 of vehicle 10 for respectively providing support to the carriages which respectively carry crawlers 38. Each carriage support structure 78 includes a pair of longitudinally spaced uprights 80 which are secured to the base of frame 32 and extend upwardly therefrom, and a longitudinal beam 82 extending between and connected to uprights 80.

With continued reference to FIGS. 1 and 2, conveyor suspension structure 46 includes on each side of frame 32 a pair of longitudinally spaced uprights 84 secured to and extending vertically and perpendicularly upward from each of primary side rails 62A and 62B. Braces 86 are secured respectively to uprights 84 and angle downwardly therefrom and are secured to one of rails 62 to provide additional support to uprights 84. A horizontal longitudinal upper rail 88 is provided on each side of frame 32 and extends between and is connected to the respective pair of uprights 84 on the respective side. A pair of longitudinally spaced overhead axial support beams 90 are connected to and extend horizontally between upper rails 88 to provide a support structure from which conveyor assembly 44 is suspended. In the operational configuration of conveyor assembly 44, it hangs downwardly from and is supported entirely from above by beams 90.

Figure 3:
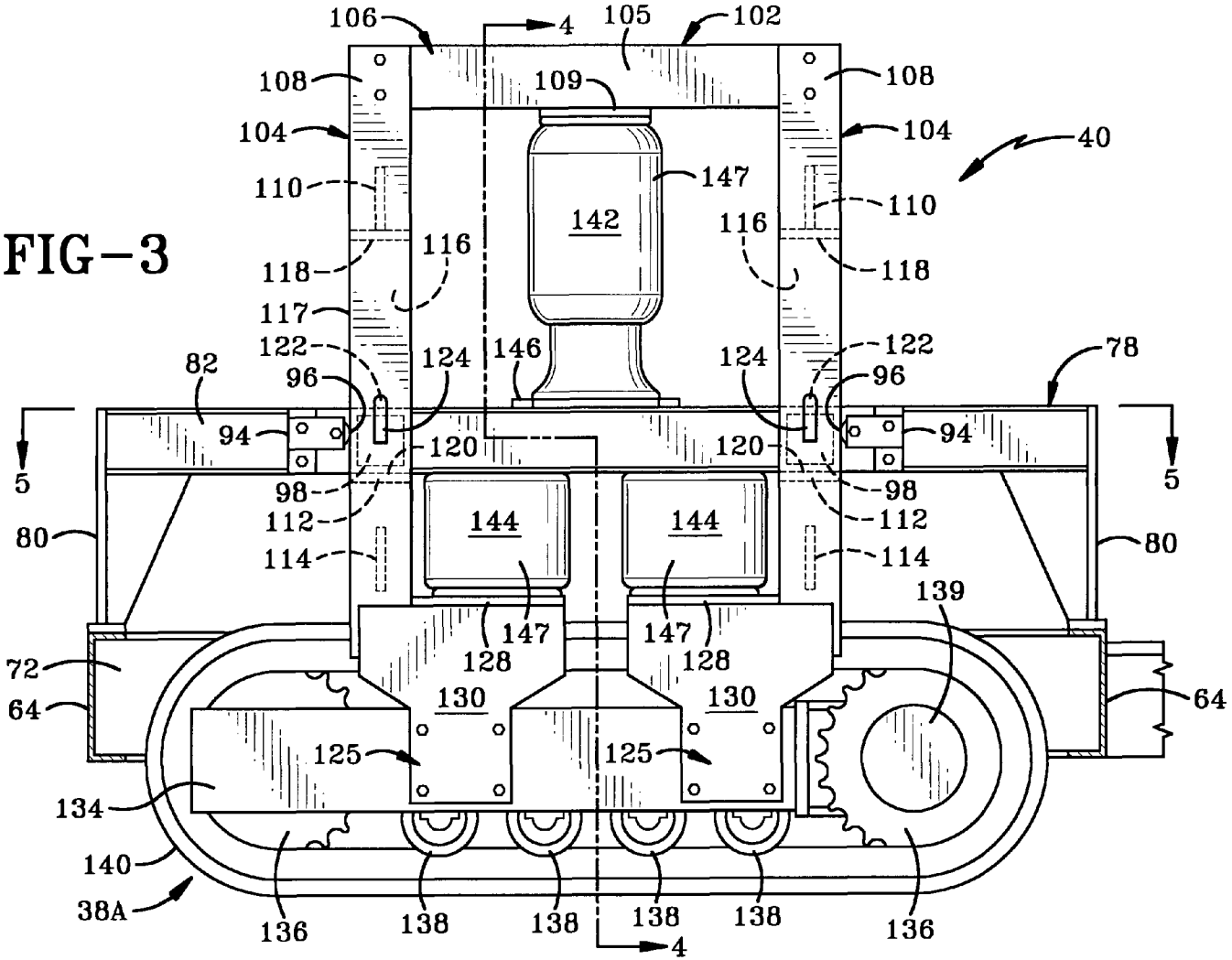
FIG. 3 is an enlarged view of one of the pneumatic crawler lifts and suspension assemblies and shows the crawler in its raised position.
Figure 4:
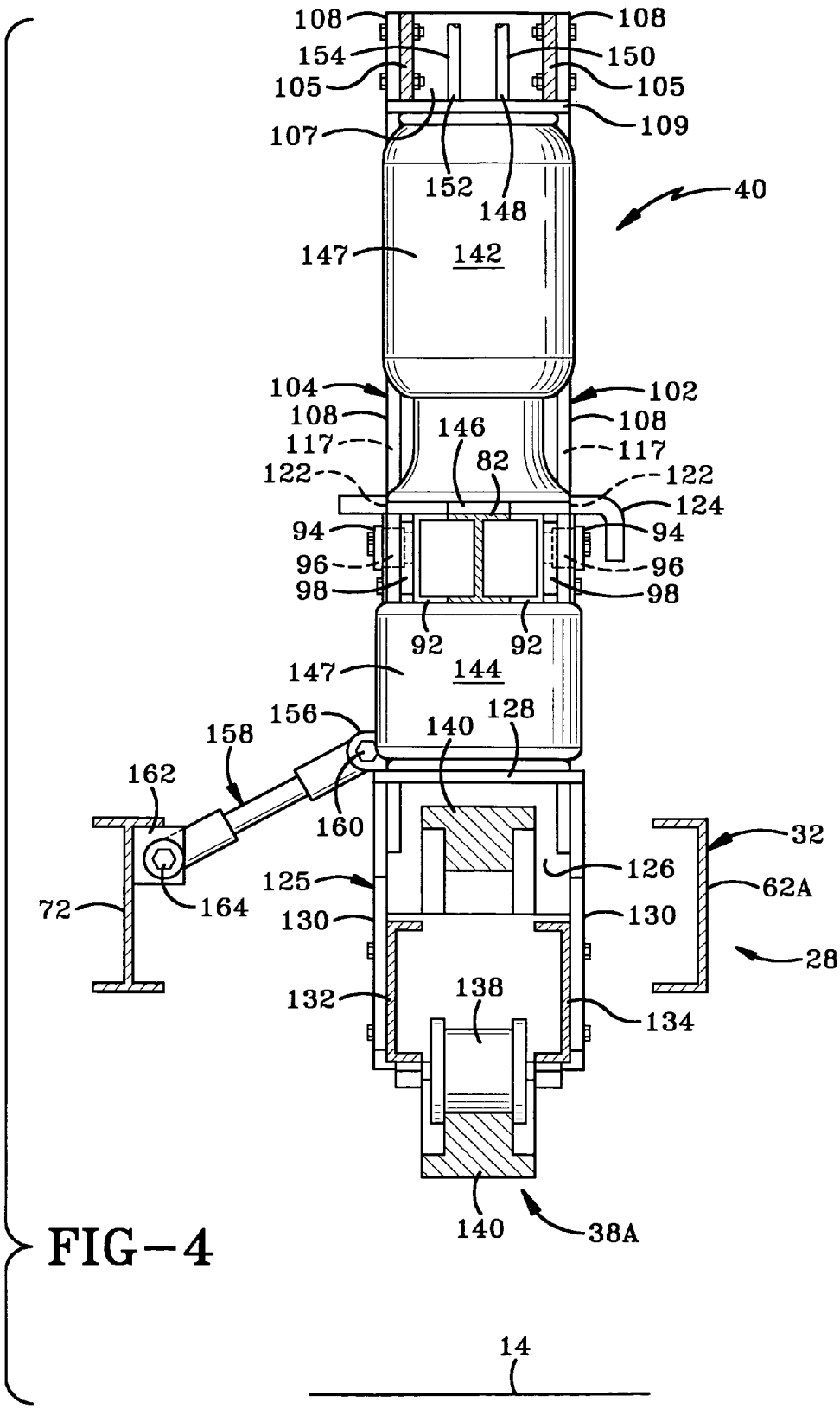
FIG. 4 is a sectional view taken on line 4-4 of FIG. 3.
Figure 5:
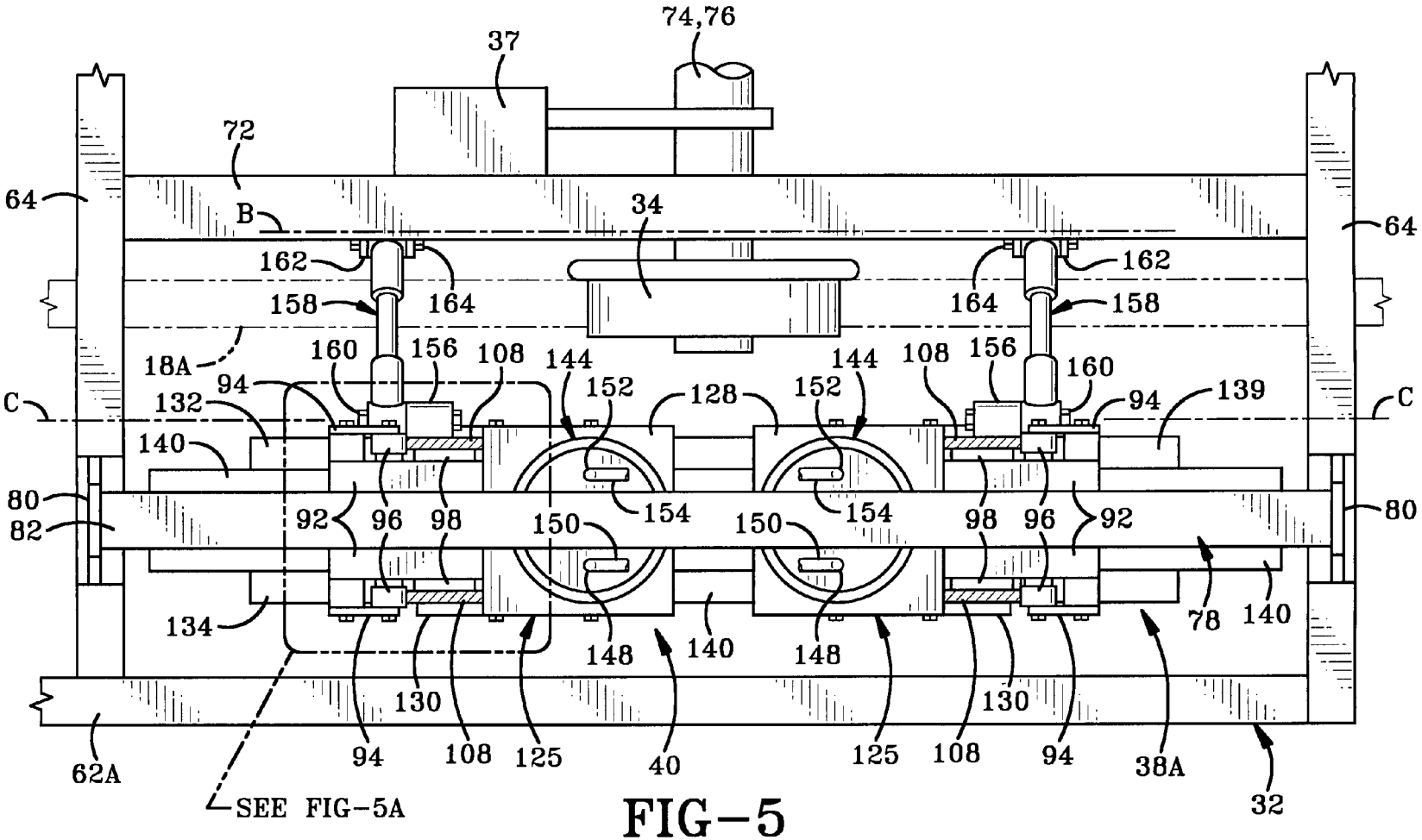
FIG. 5 is a sectional view taken on line 5-5 of FIG. 3.

Referring now to FIGS. 3-5, carriage support structure 78 is described in greater detail. In the exemplary embodiment, longitudinal beam 82 is in the form of an I-beam. Spaced inwardly from the opposed ends of beam 82 is a mounting structure comprising a pair of U-shaped channel members 92 which are respectively secured to the upper and lower flanges of I-beam 82 (FIG. 4) so that the mounting structure is wider than is beam 82. On each side of beam 82, a roller mounting bracket 94 is secured to one of channel members 92 for rotatably mounting thereon a wheel or roller 96. Adjacent each roller 96 and inwardly from the opposed ends of beam 82, slide members or pads 98 (FIGS. 4-5A) are secured on channel members 92 and extend outwardly therefrom to respective slide surfaces 100 (FIG. 5A).

With continued reference to FIGS. 3-5A, crawler lift and suspension assembly 40 is described in greater detail. Assembly 40 includes a crawler carriage 102 on which crawler 38 is mounted. Carriage 102 is a generally rectangular structure having a base from which a pair of longitudinally spaced vertical uprights 104 extend upwardly. A longitudinal upper beam 106 extends between and is connected at its opposed ends to the upper ends of uprights 104. Upper beam 106 includes a pair of axially spaced plates or arms 105, a central cross member 107 extending between and secured to each of arms 105 and a horizontal mounting plate 109 secured to the bottom of each arm 105 and cross member 107. Each upright 104 includes a pair of axially spaced flat plates or arms 108 with vertically spaced upper, intermediate and lower cross members 110, 112 and 114 connected to and extending between each pair of arms 108. Each pair of arms 108 thus defines therebetween a through opening 116 which is bounded by and below upper cross member 110 and above intermediate cross member 112. Each arm 108 has an inner slide surface 115 (FIG. 5A) which bounds through opening 116 and slidably engages one of slide surfaces 100 of a respective pad 98 during the raising and lowing of carriage 102 and crawler 38. Each arm 108 further includes a roller engaging surface 117 which is rollably engaged by the circular outer surface of a respective roller 96 during the raising and lowering of carriage 102 and crawler 38. Longitudinal beam 82 extends through each through opening 116 and outwardly beyond said respectively openings in forward and rearward directions. Upper cross member 110 has a lower downwardly facing surface 118 and intermediate member 112 has an upper upwardly facing surface 120. A hole 122 is formed in each arm 108 so that a pair of holes 122 formed respectively in the arms 108 of each upright 104 are aligned for removably receiving therethrough a locking or support pin 124. When beam 82 is seated on or closely adjacent upper surface 120 of intermediate cross member 112, holes 122 are disposed above and closely adjacent the upper surface of beam 82, as are pins 124 when received within holes 122. This is the raised position of carriage 102 and crawler 38 (FIG. 3) and thus pins 124 support carriage 102 and crawler 38 in the raised position via engagement betweens pins 124 and the upper surface of beam 82. The base of each carriage 102 includes a pair of inverted U-shaped members 125 defining a longitudinally extending through passage 126 and including an upper platform 128 and a pair of downwardly depending legs 130. Inner and outer longitudinal mounting beams 132 and 134 are secured respectively to the inner and outer legs 130 of member 124 for rotatably mounting thereon front and rear sprocket wheels 136 one of which is typically a drive wheel and the other of which is typically an idler wheel. While various types of drive mechanisms may be used to drive the drive wheel 136, in the exemplary embodiment, a hydraulic crawler driver motor 139 serves this purpose, and is shown diagrammatically in FIG. 3. Several guide and support wheels 138 are also rotatably mounted along the bottom of mounting beams 132. A crawler track 140 is revolvably mounted around wheels 136 and 138 and driven by the drive wheel in order to provide travel of vehicle 10 when crawler 38 and carriage 102 is in the lowered position.

Assembly 40 further includes an upper air spring 142 and a pair of lower air springs 144. Upper air spring 142 has a lower end which is secured to a mounting plate 146 atop beam 82 and extends upwardly therefrom to an upper end which is secured to the bottom of mounting plate 109. Thus, upper air spring 142 extends between beam 82 of frame 32 and upper beam 106 of carriage 102. Each lower air spring 144 has a lower surface which is seated atop a respective platform 128 and extends upwardly therefrom to an upper end which abuts the lower surface of beam 82. Each of springs 144 thus extends between the base of carriage 102 and beam 82 of frame 32. Each of air springs 142 and 144 typically includes a reinforced elastomeric bladder 147 defining an interior chamber for receiving air or another gas for inflation and deflation of bladder 147. To effect this inflation and deflation, each of air springs 142 and 144 are provided with an air inlet 148 which typically utilizes a one-way valve with a pneumatic inlet line 150 connected thereto and in communication with pneumatic compressor 58 (FIG. 2). Each air spring is also provided with an air outlet 152 which typically includes a one-way valve allowing air to exit from within bladder 147 and may include an outlet line in communication therewith.

Figure 5A:
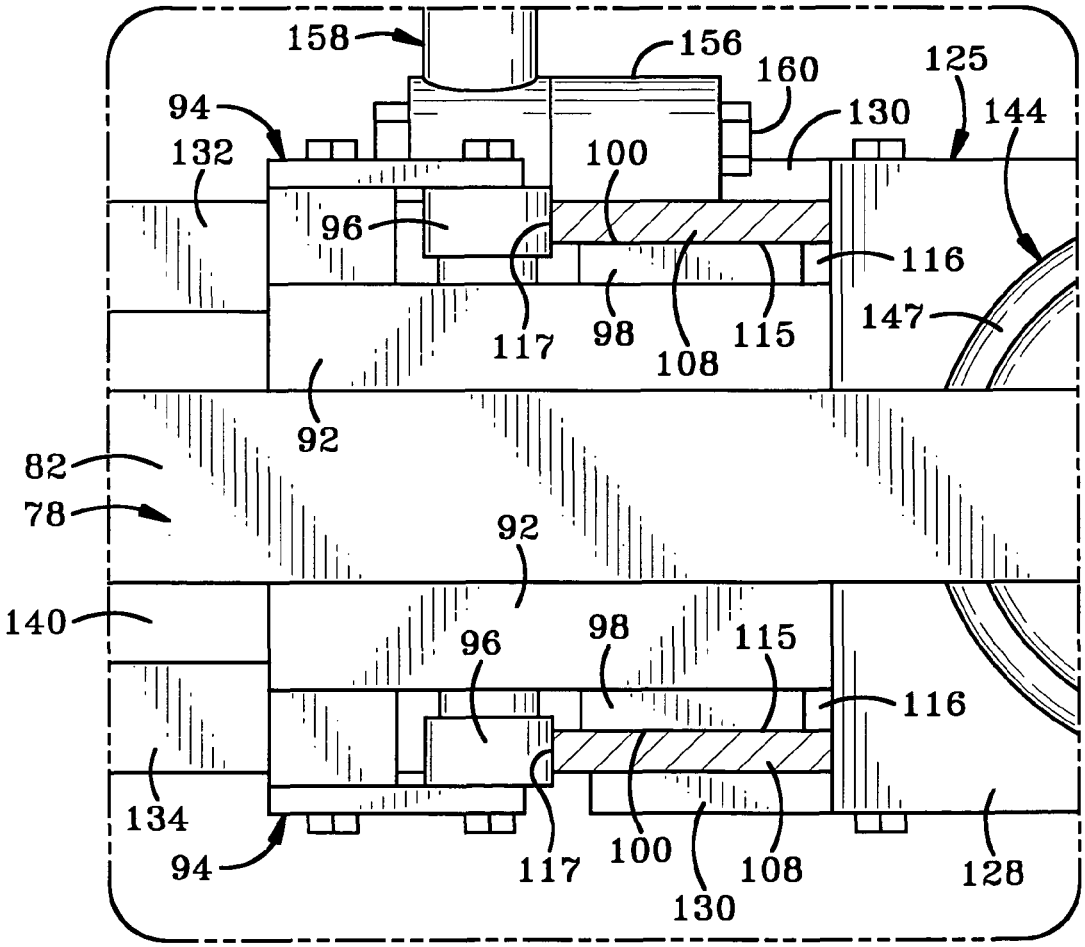
FIG. 5A is an enlarged view of the encircled portion of FIG. 5.
Figure 6:
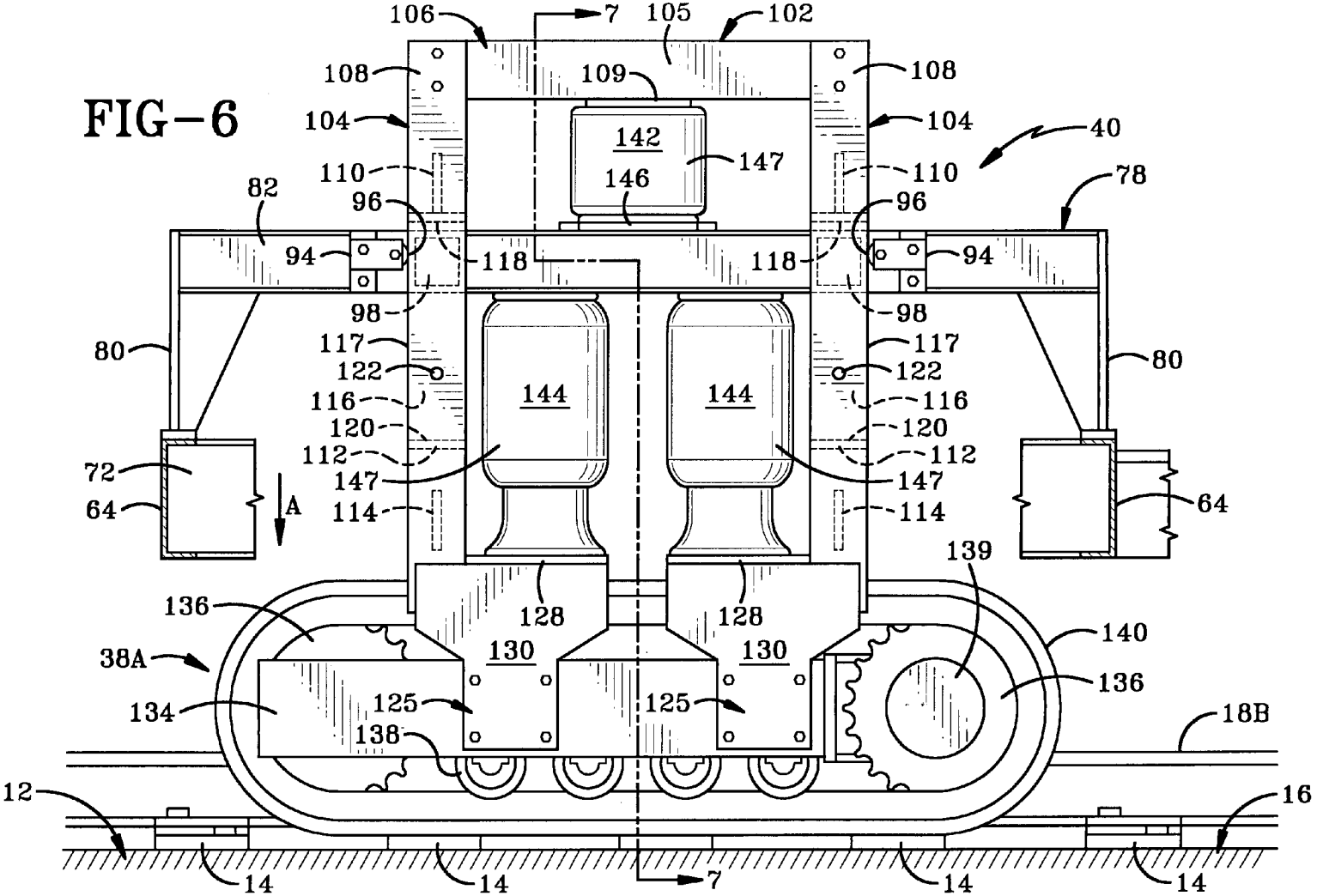
FIG. 6 is similar to FIG. 3 and shows the crawler in its lowered position.

Referring to FIGS. 4-5A, a pivot mount 156 is rigidly mounted on and extends outwardly from the inner arm 108 of each upright 104 for pivotally mounting thereon a tie rod 158 via a pivot 160 which extends through respective holes formed in pivot mount 156 and tie rod 158 adjacent its outer end. Another pivot mount 162 is rigidly mounted on one of rear longitudinal rails 72 for pivotally mounting tie rod 158 thereon via another pivot 164 which passes through respective holes formed in pivot mount 162 and tie rod 158 adjacent its inner end. Tie rod 158 is provided to help control the raising and lowering movement of carriage 102 and crawler 38.

The basic operation of lift and suspension assembly 40 is described with reference to FIGS. 3-7. FIG. 3 shows carriage 102 and crawler 38 in its raised position which is associated with vehicle 10 riding on both rails of the railroad track with crawler 38 out of contact with railway bed 12. In order to lower carriage 102 and crawler 38 to the lowered position, pins 124 are removed from holes 122 whereby carriage 102 and crawler 38 are supported in the raised position only by air spring 142 in an inflated state. Once pins 124 have been removed, upper air spring 142 is deflated while lower air springs 144 are inflated to move carriage 102 and crawler 38 downwardly (Arrows A in FIGS. 6-7). More particularly, the air outlet valve 152 of upper air spring 142 is operated to release air from within air spring 142, thus reducing the pressure therein to deflate air spring 142 while simultaneously air pressure provided via pneumatic reservoir and compressor 58 is pumped into lower air springs 142 via their respective air inlet valves 148 to increase the pressure therein and thus inflate air springs 144. Although the weight of carriage 102 and crawler 38 provides gravitational force to help deflate upper air spring 142, the inflation of lower air springs 144 provides a downward force on platforms 128 which is translated to upper beam 106 via uprights 104 so that upper beam 106 presses downwardly on air spring 142 to further accelerate its deflation and the downward movement of carriage 102. In addition, lower air springs 144 in their inflated state provide suspension of vehicle 10 along the side 28 or 30 depending on which crawlers 38 are in the lowered position. Thus, when the crawlers 38 on one side of vehicle 10 are lowered into contact with railway bed 12, lower springs 144 provide both the suspension of vehicle 10 as well as shock absorbing capacity during the travel of vehicle 10 along railway bed 12.

Figure 7:
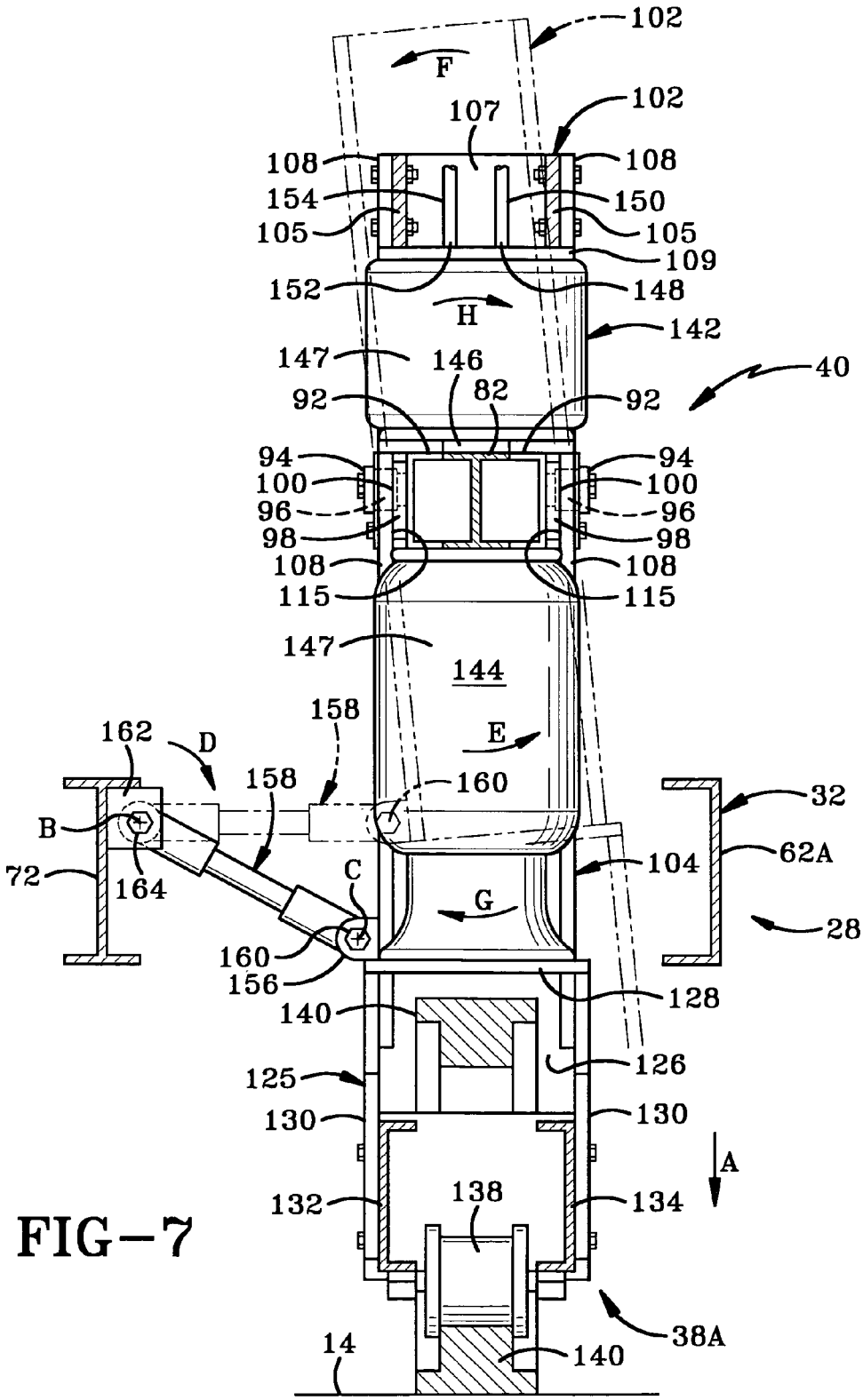
FIG. 7 is a sectional view taken on line 7-7 of FIG. 6.

As noted above, tie rods 158 provide control and stabilization of carriage 102 and crawler 38 during the process of raising and lowering carriage 102 as well as when carriage 102 is stationary in the raised position or in the lowered position. As shown in FIGS. 5 and 7, tie rod 158 pivots about a substantially horizontal longitudinal axis B which passes through pivots 164 while carriage 102 and crawler 38 pivot about a parallel axis C which passes through pivots 160. Thus, although carriage 102 and crawler 38 move generally vertically downwardly and upwardly, they also pivot to a limited degree during this process. As more particularly shown in FIG. 7, the downward pivotal movement of tie rod 158 (Arrow D) from the raised position of FIG. 4 to the horizontal position of tie rod 158 shown in phantom lines in FIG. 7 causes pivot 160 and the outer ends of tie rod 158 to move axially outwardly relative to pivot 164 and longitudinal rail 72 so that crawler 38 and the portion of carriage 102 which is below pads 98 during this movement are pivoted axially outwardly (Arrow E) loosely about slide surfaces 100 of pads 98 while the portion of carriage 102 there above pivots axially inwardly (Arrow F). As the pivotal movement of tie rod 158 and carriage 102 continues downwardly from the position shown in phantom lines to the position shown in solid lines to reach the lowered position of carriage 102, carriage 102 pivots loosely about surfaces 100 of pads 98 in the opposite directions (Arrows G and H). It will be evident that a similar pivotal movement occurs during the raising of carriage 102 and crawler 38 about slide surfaces 100, namely that the lower portion will pivot axially outwardly initially and then axially inwardly depending on the position of tie rod 158. As previously noted, the inner slide surfaces 115 of arms 108 slidably engage slide surfaces 100 of pads 98 during this raising and lowering process. Thus, carriage 102 and crawler 38 both slidably engage surfaces 100 of pads 98 as well as pivot there about during the raising and lowering process. To move from the lowered position of FIGS. 6 and 7 to the raised position of FIGS. 3 and 4, upper air spring 142 is inflated via its air inlet valve 148 by the pressurized air provide by pneumatic reservoir and compressor 58 while lower air springs 144 are deflated by operating their air outlet valves 152 to release air therefrom. The increasing pressure within air spring 142 during its inflation thus provides the upward force from the top of beam 82 to the bottom of upper beam 106 to move carriage 102 and crawler 38 upwardly to its raised position and simultaneously assist in forcing the air out of lower air springs 144 via their air outlet valves 152.

Figure 8:
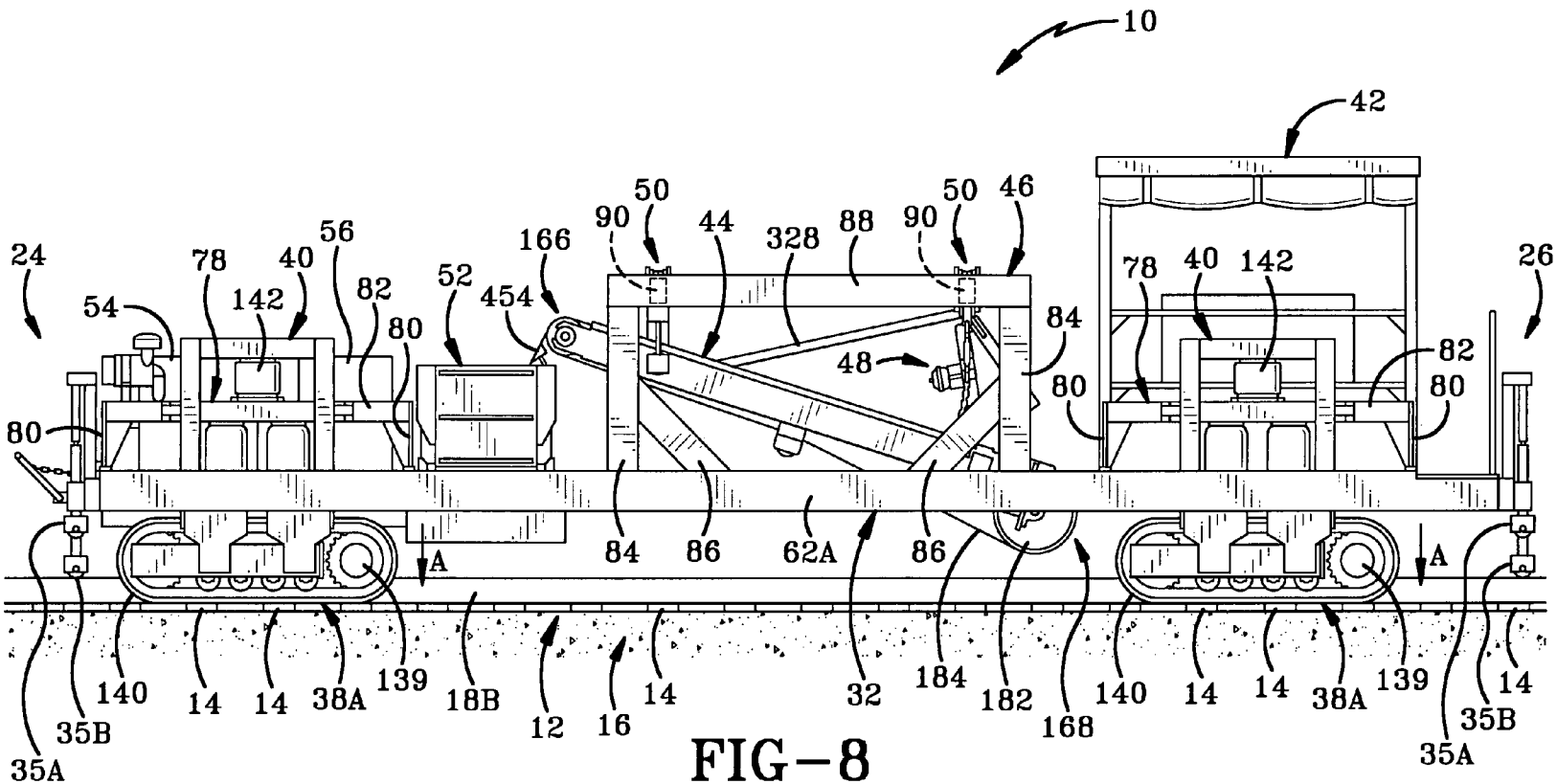
FIG. 8 is similar to FIG. 1 and shows the crawlers on the left side of the vehicle in their lowered positions.
Figure 9:
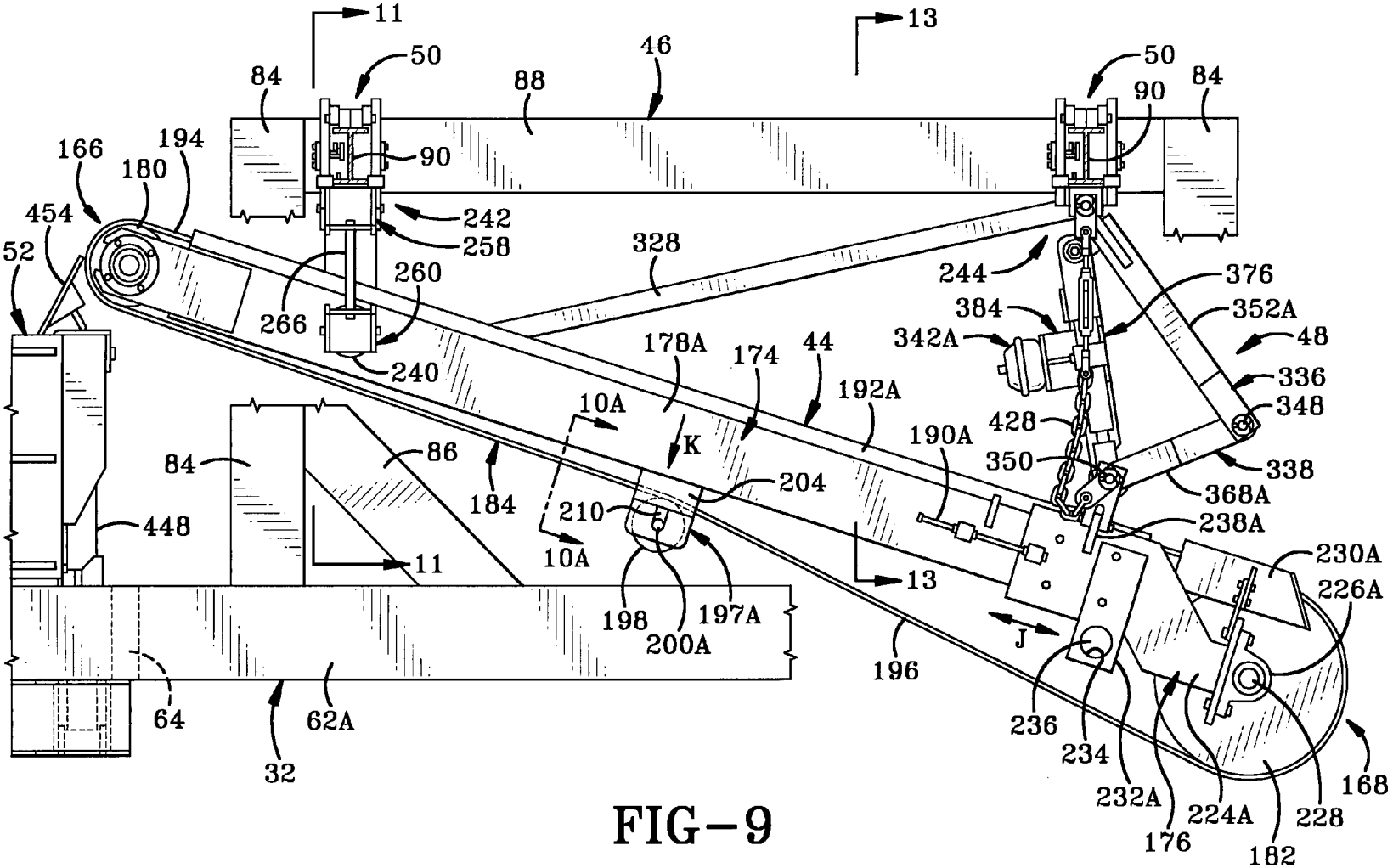
FIG. 9 is an enlarged side elevational view taken from the left side with portions cut away showing the conveyor belt assembly, its lift and portions of its lateral translator.

FIG. 8 show crawlers 38A in their lowered position so that vehicle 10 is configured to travel along the railroad track with crawlers 38A engaging railway bed 12 and wheels 36 (FIG. 2) riding along rail 18B. To ensure that wheels 36 do not slip off of rail 18B, two of the guide wheel assembly actuators are hydraulically operated to lower front and rear guide wheels 35B into engagement with rail 18B whereby the circular flanges of wheels 35B are positioned on the opposite side of rail 18B from the circular flanges of wheels 36. The respective flanges of wheels 35B and 36 thus limit the axial movement of vehicle 10 relative to rail 18B to keep wheels 35B and 36 atop rail 18B.

With reference to FIGS. 9-17, conveyor belt assembly 44, conveyor lift 48 and lateral translator 50 are described in greater detail. We first turn our attention to conveyor belt assembly 44 with primary reference to FIGS. 9 and 10. Assembly 44 has front and rear ends 166 and 168 defining therebetween a length of assembly 44. Assembly 44 also has first and second or left and right sides 170 and 172 (FIGS. 2, 24) which define therebetween a width of assembly 44. Assembly 44 has a first main frame section 174 and a second frame section or roller carriage 176 mounted on the rear end of first section 174. First section 174 includes first and second axially spaced parallel side rails 178A (FIG. 9) and 178B (FIG. 10) extending respectively along first and second sides 170 and 172 and secured to one another by various cross members extending therebetween and rigidly connected thereto.

A front or upper roller 180 is rotatably mounted on first section 174 adjacent its front end and a rear or lower roller 182 is rotatably mounted on roller carriage 176 adjacent its rear end. A conveyor belt 184 forming a continuous loop is revolvably mounted on assembly 44 and circumscribes rollers 180 and 182 as well as portions of first and second sections 174 and 176. A motor 186 (FIG. 10) is secured to first section 174 adjacent its front end for driving rotation of upper roller 180 which in turn drives the revolution of conveyor belt 184 about rollers 180 and 182 to drive rotation of roller 182. Motor 186 in the exemplary embodiment is a hydraulic motor which is in fluid communication with hydraulic reservoir and pump 56 via hydraulic lines 188 and is thus hydraulically powered by pump 56. Rear roller 182 is a magnetic roller which is used to magnetically pick up metallic objects such as tie plates 20 and spikes 22 (FIG. 18). More particularly, roller 182 is typically a hollow drum with numerous powerful permanent magnets within its interior chamber adjacent the outer perimeter of roller 182 which provide a sufficient magnetic field for picking up even tie plates through the material forming conveyor belt 184. Belt 184 is typically formed of a rubber or other elastomeric material which is reinforced with various fibers embedded therein. Adjustment screws 190A (FIG. 9) and 190B (FIG. 10) are provided on either side of assembly 44 to provide an adjustment mechanism for adjusting roller carriage 176 relative to first section 174 (Arrow J in FIG. 9), thus adjusting the overall length of assembly 44 to tighten or loosen conveyor belt 184. Guide rails 192A and B extend upwardly respectively from side rails 178A and B for guiding the movement of conveyor belt 184 and the metallic objects conveyed thereby. As conveyor belt 184 revolves around rollers 180 and 182, it will have at any given time an upper segment 194 which extends generally from the top of roller 180 to the top of roller 182 and a lower segment 196 which extends generally from the bottom of roller 180 to the bottom of roller 182.

A pair of mounting brackets or flanges 197A and B are secured to and extend downwardly respectively from side rails 178A and B generally adjacent the midpoint between rollers 180 and 182. A support roller 198 is rotatably mounted on flanges 197 and extends axially therebetween. Roller 198 is an idler roller the cylindrical outer perimeter of which rollingly engages the lower surface of lower segment 196 of belt 184 as belt 184 revolves. A pair of cylindrical posts or axles 200A and B extends outwardly from the center of either end of roller 198 and are received within respective openings of mounting flanges 197A and B for rotatably supporting roller 198.

Figure 10:
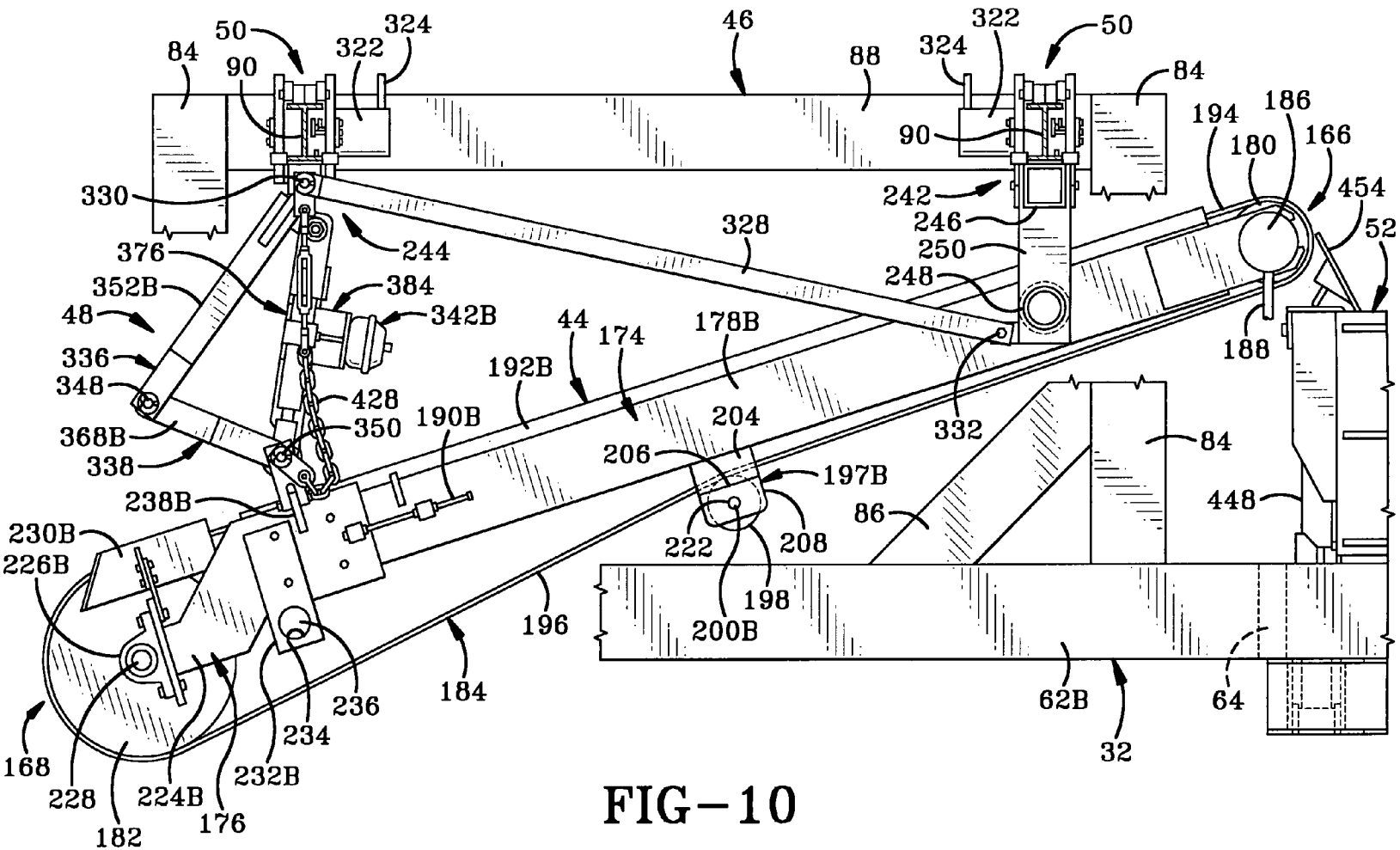
FIG. 10 is a side elevational view taken from the right side with portions cut away showing the same general structure as FIG. 9.
Figure 10A:
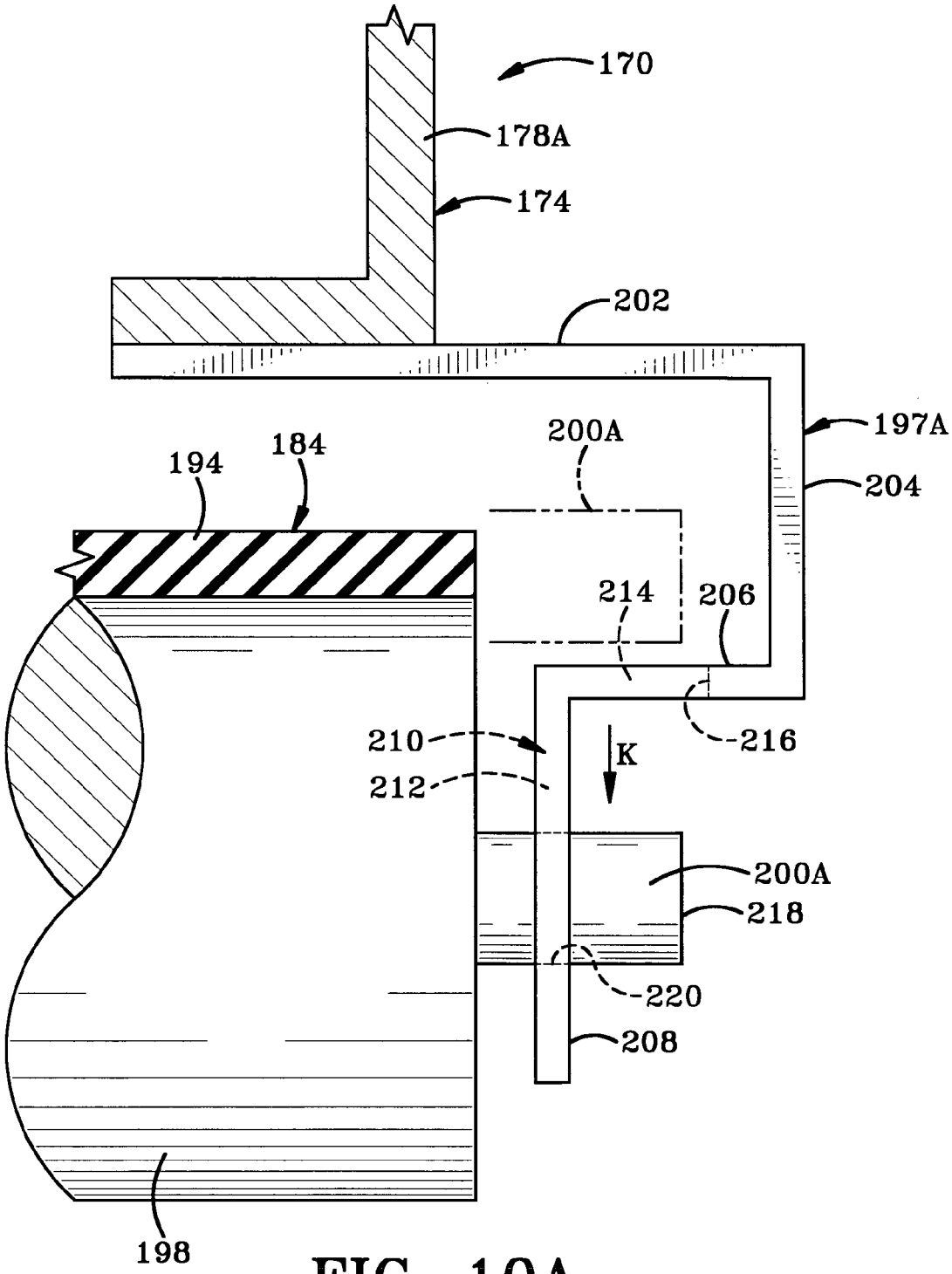
FIG. 10A is an enlarged sectional view taken on line 10A-10A of FIG. 9.
Figure 11:
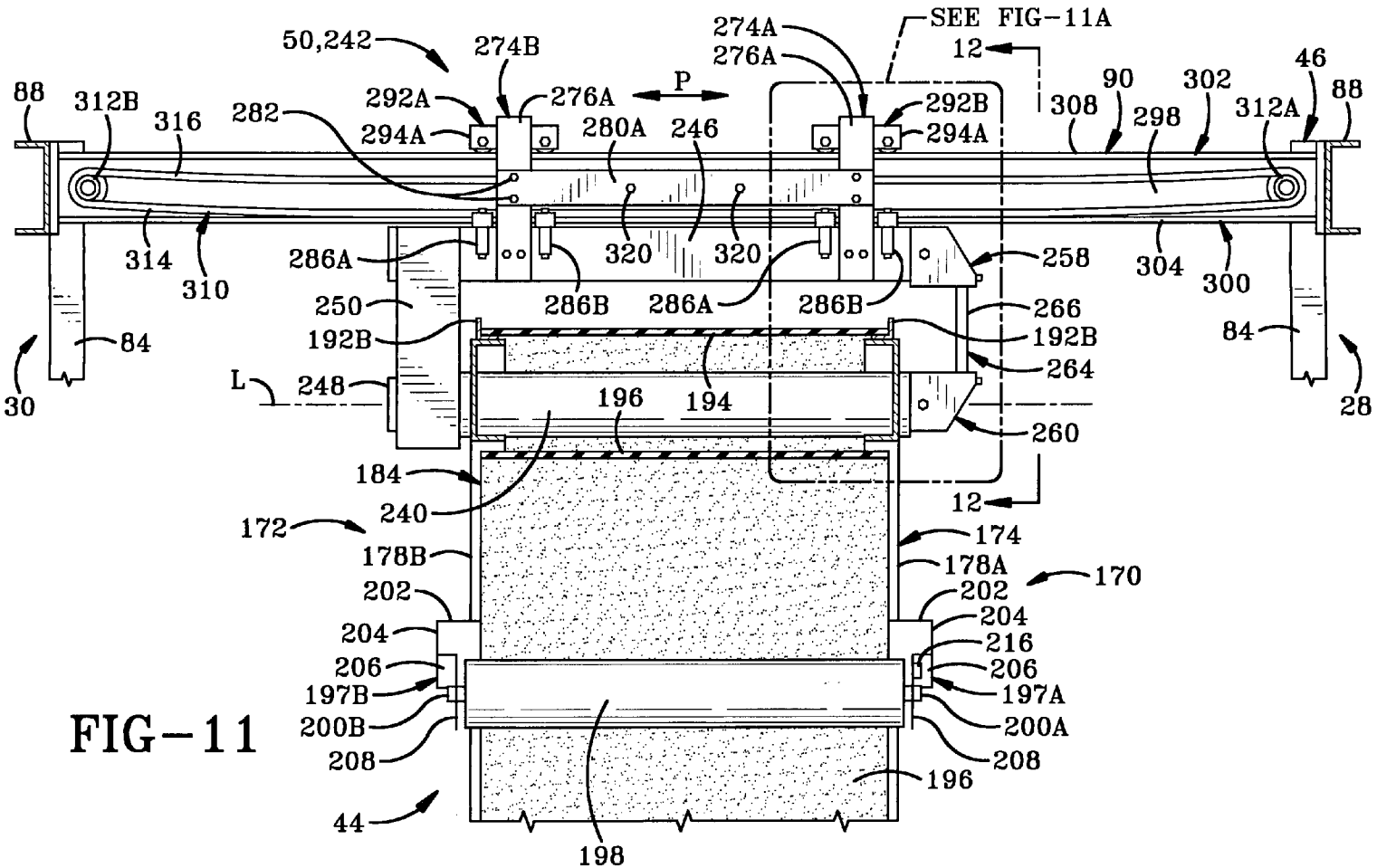
FIG. 11 is a sectional view taken on line 11-11 of FIG. 9.

Flange 197A is described in greater detail with reference to FIGS.10A and 11. As shown in FIG. 10A, flange 197A is secured to the bottom of side rail 178A. Flange 197A includes a top wall 202 secured to the bottom of side rail 178A and extending laterally outwardly therefrom, an outer wall 204 which is connected to and extends downwardly from the outer end of top wall 202, a connecting wall 206 which is secured to the lower end of outer wall 204 and extends laterally axially inward therefrom, and a vertical bottom wall 208 which is connected to and extends downwardly from the inner end of connecting wall 206. An L-shaped slot 210 is formed in walls 206 and 208 and includes an upwardly extending section 212 formed in wall 208 and a laterally extending section 214 formed in wall 206 which communicates with section 212 and extends laterally outwardly therefrom to a terminal end 216 which is spaced laterally outwardly further than the terminal end 218 of axle 200A. Axle 218 may thus be installed within slot 210 simply by lowering it (Arrow K) from the position shown in phantom lines in FIG. 10A to the position shown in solid lines in FIG. 1A, thus passing through laterally extending section 214 and downwardly into upwardly extending section 212 to be seated on bottom 220 of slot 210 with a portion of axle 200A extending laterally outwardly beyond wall 208 and section 212 of slot 210. Mounting flange 197B may have the same configuration as flange 197A although positioned in a mirror image fashion on the other side of conveyor belt assembly 44. However, it may also be formed as shown in FIG. 10 simply with an opening 222 formed solely through its bottom wall 208 for receiving therethrough axle 200B. Thus, axle 200B may be inserted by moving roller 198 laterally in the axial direction so that axle 200B is supported by mounting flange 197B within opening 222 prior to lowering axle 200A into slot 210 as previously described. This mounting configuration of roller 198 allows it to be easily installed and removed from flanges 197, preferably without the use of tools. The weight of the roller itself and the weight of lower segment 196 of belt 184 typically ensure that roller 198 will not be inadvertently removed from flanges 197 during operation.

Roller carriage 176 includes first and second primary plates or arms 224A (FIG. 9) and 224B (FIG. 10) which are axially spaced from one another and generally along left and right sides 170 and 172 respectively. Left and right roller mounting brackets 226A and 226B are respectively attached to the rear of main arms 224A and 224B and include bearings for rotatably mounting thereon an axle 228 of roller 182. Left and right belt guides 230A and 230B are secured adjacent the respective rear ends of main arms 224 above mounting brackets 226 and serve to guide belt 184 during its movement adjacent the top of roller 182. Guides 230 also serve to force metallic objects which extend outwardly from roller 182 to a more central position atop conveyor belt 184 or serve to strip them off the sides of roller 182 or along the edges of conveyor belt 184. Forward of roller 182, a pair of pole-mounting or bar-mounting brackets 232A and B are secured respectively to arms 224 and extend downwardly therefrom. Holes 234 are formed respectively in brackets 232 and aligned horizontally and axially with one another. An open space 236 is formed between brackets 232 and more particularly between holes 234 whereby space 236 is free of obstructions so that a pole may be inserted through holes 234 and space 236 as will be discussed further below. Left and right upper mounting brackets 238A and B are secured to and extend upwardly from arms 224 respectively.

Referring now to FIGS. 9-13, lateral translator 50 and the structure by which conveyor assembly 44 is suspended from translator 50 is described in greater detail. It is first noted that conveyor assembly 44 includes a pivot tube 240 which is generally adjacent and rearward of front roller 180 and which extends between and is rigidly secured to first and second side rails 178A and B and extends axially outwardly of said rails a short distance. Vehicle 10 further includes front and rear suspension assemblies 242 and 244, the latter including conveyor lift 48 or portions thereof. Front suspension assembly 242 will be described first with primary reference to FIGS. 11-12. Front assembly 242 includes a substantially horizontal upper axial arm 246, a substantially horizontal lower axial arm 248 and an upwardly extending arm 250 which is typically substantially vertical. Arm 250 in the exemplary embodiment extends between upper and lower arms 246 and 248 and is rigidly connected thereto adjacent and axially outward of side 172 of conveyor assembly 44. Thus, arms 246, 248 and 250 in the exemplary embodiment form a C-shaped or U-shaped rigid structure. Arm 248 serves as a pivot and is typically in the form of a cylindrical tube having an outer diameter which is slightly smaller than the inner diameter of cylindrical pivot tube 240 whereby conveyor assembly 44 is pivotally moveable about a horizontal axially extending axis L (FIG. 11) extending along the center of tubes 248 and 240.

Figure 11A:
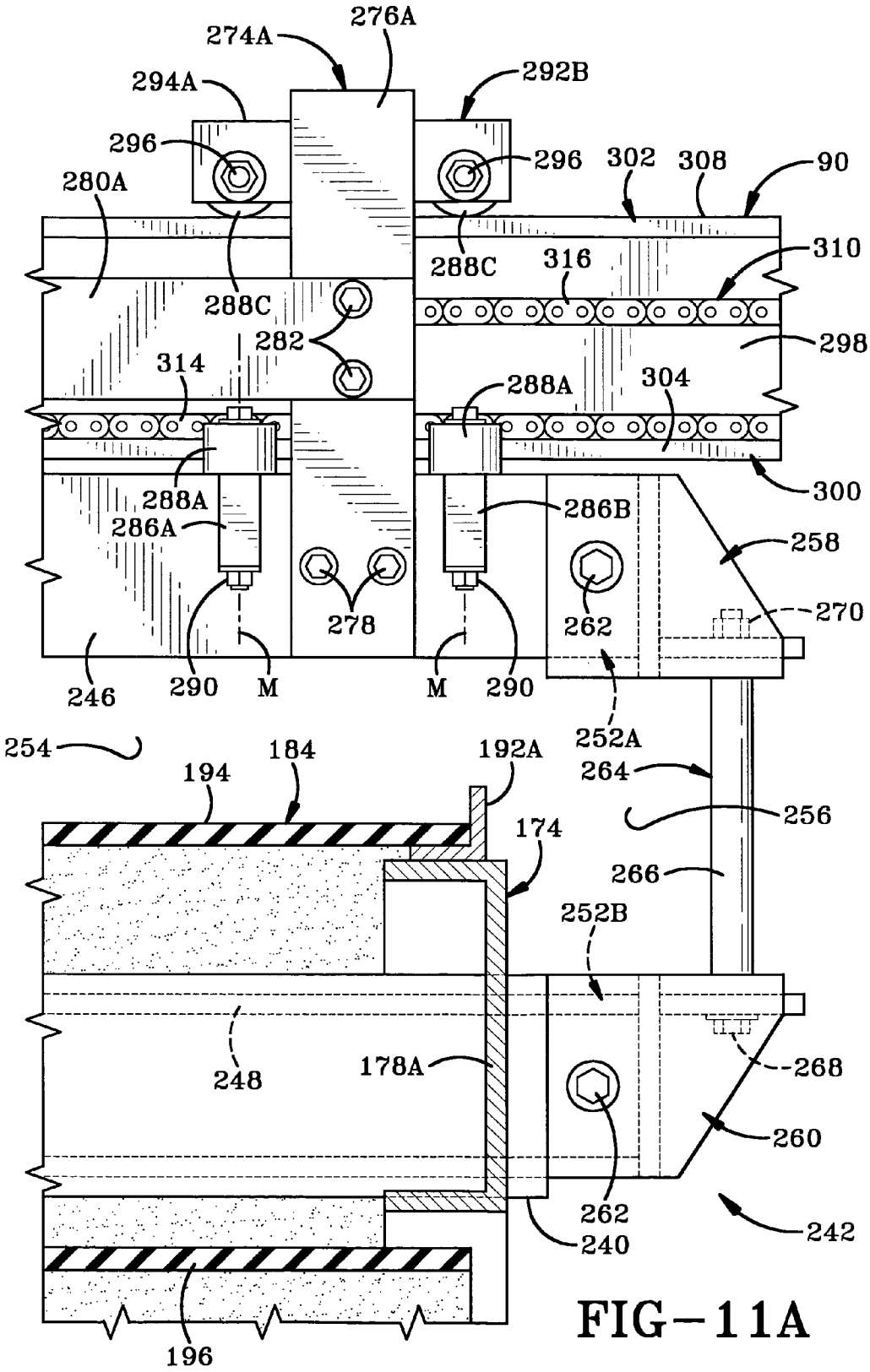
FIG. 11A is an enlarged view of the encircled portion of FIG. 11.

Arms 246 and 248 are secured adjacent respective first ends thereof to arm 250 and extend generally parallel to one another to free upper and lower terminal ends 252A and 252B. Arms 246 and 248 define therebetween a space 254 which is bounded by arm 250 and in which is received upper segment 194 of conveyor belt 184 and the upper portions of side rails 178A and 178B. Space 254 includes a space 256 directly between the terminal ends 252A and 252B (FIG. 11A). Upper and lower mounting brackets 258 and 260 are mounted respectively on upper and lower arms 246 and 248 at terminal ends 252A and B. Upper bracket 258 is shown mounted on upper arm 246 by fastener 262 in the form of a nut and bolt which threadably engage one another whereby bracket 258 is removably mounted on arm 246. However, a bracket 258 may be permanently mounted on arm 246 by welding or the like. Lower mounting bracket 260 is also shown as being secured to lower arm 248 by a fastener 262 in the form of a bolt and nut having a threaded engagement whereby bracket 260 is removably mounted on arm 248. The Lower fastener 262 extends through respective holes formed in bracket 260 and tube 248. The removable mounting of bracket is desired in order to facilitate removal of pivot tube 240 from tube 248 in the event that conveyor assembly 44 needs to be removed for repair or replacement. While arm 250 serves as a suspension member for suspending lower arm 248 from upper arm 246 along side 172 of conveyor assembly 44, another suspension member 264 extends downwardly generally vertically from upper bracket 258 to lower bracket 260 whereby lower arm 248 and lower bracket 260 are suspended from upper arm 246 and upper bracket 258 along side 170 of conveyor assembly 44. Suspension member 264 includes a spacer 266 having an upper end which abuts the lower surface of bracket 258 and a lower end which abuts the upper surface of bracket 260 to set the height of space 256. Spacer 266 is in the form of a hollow tube through which a threaded bolt 268 extends and which is threadedly engaged by a nut 270 to secure brackets 258 and 260 to one another in this vertically spaced arrangement. Bolt 68 extends through holes 272 (FIG. 12) formed respectively in brackets 258 and 260.

Figure 12:
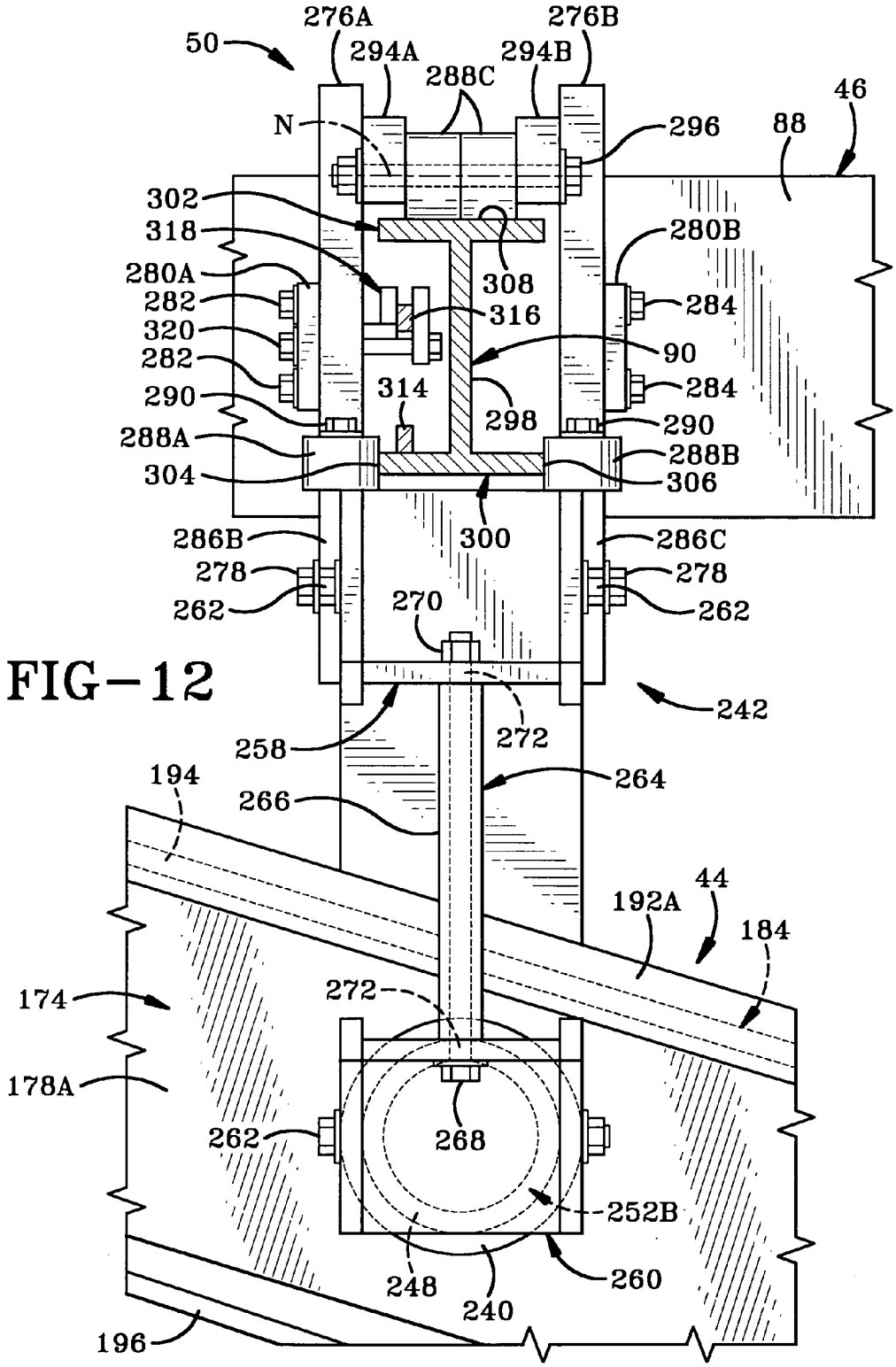
FIG. 12 is a sectional view taken on line 12-12 of FIG. 11.

Front suspension assembly 242 further includes additional structures for securing upper arm 246 to the front axial support beam 90 of conveyor suspension structure 46. As shown in FIG. 11, assembly 242 includes left and right mounting structures 274A and 274B which are axially spaced from one another and extend upwardly from connection with upper arm 246 for mounting arm 246 on front beam 90. Each of structures 274A and B are substantially the same and include front and rear longitudinally spaced uprights 276A and 276B (FIG. 12). The lower portions of uprights 276 are rigidly secured respectively to the front and back of arm 246 in a suitable fashion and in the exemplary embodiment by a pair of fasteners 278 typically in the form of a nut and bolt combination with the bolt fastened through respective holes in uprights 276 and arm 246. A front horizontal axial crossbar 280A is rigidly connected to and extends between front uprights 276A, being connected thereto in the exemplary embodiment by a pair of nut and bolt fasteners 282. A rear axial crossbar 280B likewise extends horizontally between and is rigidly connected to rear uprights 276B in the exemplary embodiment by nut and bolt fasteners 284.

Two pairs of roller mounts 286A and B are rigidly secured typically by welding to the front of upper bar 246 and extend forward therefrom on opposite sides of each of front uprights 274A. Front rollers 288A are rotatably mounted about respective vertical axes M which pass through axles or pivots 290 extending through respective holes formed in each of mounts 286. Pivots 290 are in the from of nut and bolt fasteners for securing rollers 288 in position. Corresponding roller mounts 286C are mounted on the rear of upper bar 246 in the same manner as mounts 286A and B for rotatably mounting respective rear rollers 288B about a vertical axis in the same manner as rollers 288A. While only one rear mount 286C and rear roller 288B is shown in FIG. 12, there are four such rollers 286C which are respectively horizontally and longitudinally aligned with the front rollers 286A and B. Upper roller mounts 292A and B are rigidly mounted to the upper ends of each set of front and rear uprights 276A and B typically by welding. Each upper roller mount 292 includes front and rear axial bars 294A and 294B respectively secured to the rear of upright 276A and the front of upright 276B. Upper rollers 288C are rotatably mounted between front and rear bars 294A and B about a horizontal longitudinal axis N which passes through a pivot or axle 296 shown here in the form of a bolt and nut fastener in which the bolt passes through holes formed in bars 294 and roller 288C. As shown in FIG. 12, front axial support beam 90 in the exemplary embodiment is an I-beam having a vertical web 298 with lower and upper crossbars 300 and 302 secured at the respective lower and upper ends thereof. Lower crossbar 300 has front and rear edges 304 and 306 which are respectively rollingly engaged by the cylindrical outer surfaces of rollers 288A and 288B during lateral or side to side movement of conveyor assembly 44 and front suspension assembly 242. Likewise, upper crossbar 302 has a top upwardly facing surface 308 which is rollingly engaged by the cylindrical outer surface of rollers 288C during the lateral movement of assemblies 44 and 242.

A drive mechanism is provided for driving the lateral movement of conveyor assembly 44 and front suspension assembly 242 and includes a drive belt 310 (FIG. 11) typically in the form of a bicycle-type chain which is looped around first and second rollers 312A and B typically in the form of sprockets having teeth for driving the chain. Chain 310 has a lower segment 314 extending between the lower ends of sprockets 312 and an upper segment 316 extending between the upper ends of sprockets 312 and mounted on front axial crossbar 280 via a chain mounting bracket 318 (FIG. 12) secured to crossbar 280A by bolt and nut fasteners 320. Sprocket 312A is a drive sprocket and sprocket 312B is a driven or idler sprocket which is driven by chain 310 in response to the rotation of drive sprocket 312A, the rotation of which is powered by a motor 322 (FIG. 10) which in the exemplary embodiment is a hydraulic motor in communication with hydraulic pump 56 via hydraulic lines 324. This drive mechanism thus drives the back and forth lateral movement (Arrow P in FIG. 11) of conveyor assembly 44 via front suspension assembly 242, which serves as a rolling carriage for the front end of conveyor assembly 44.

Figure 13:
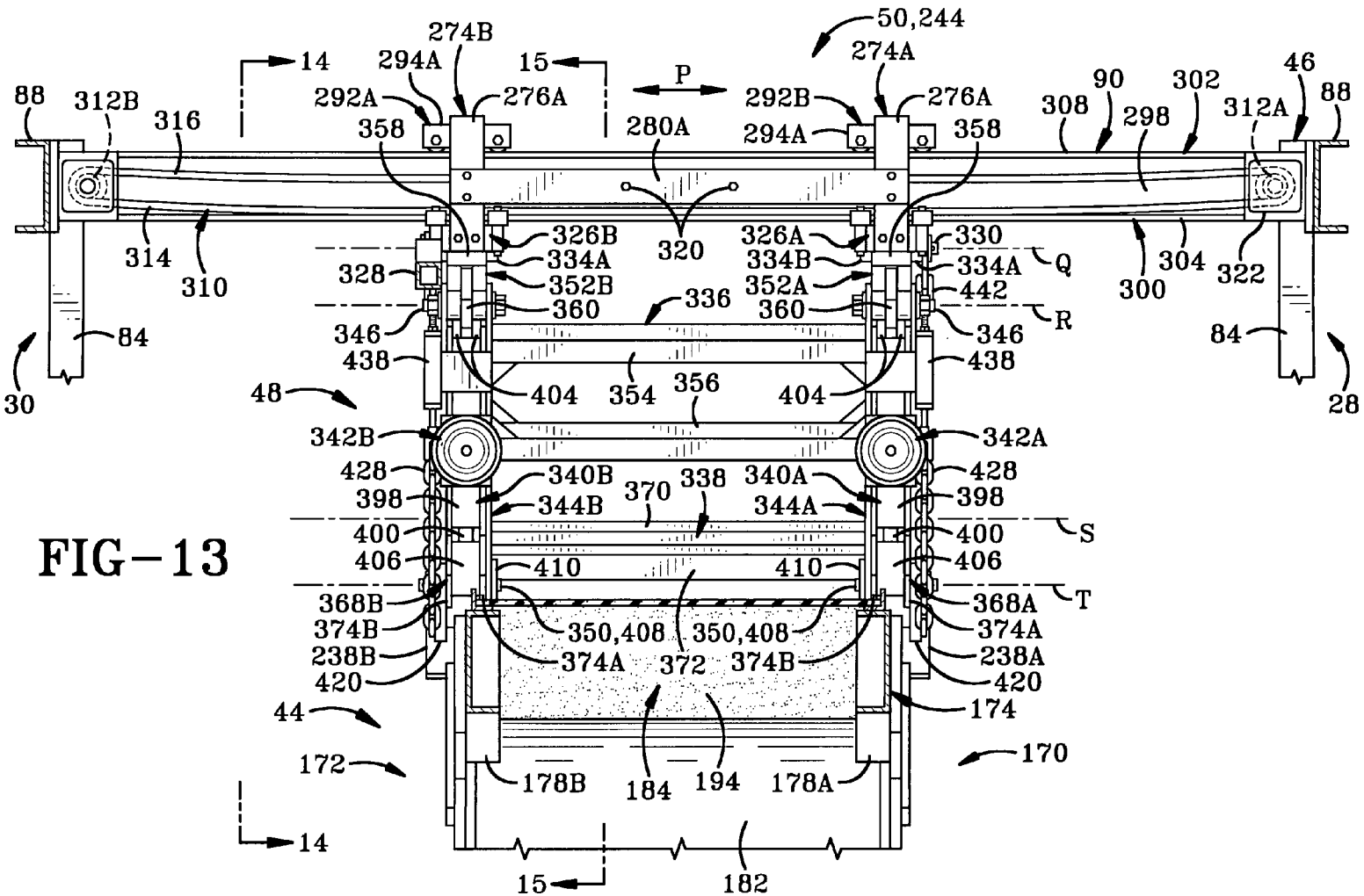
FIG. 13 is a sectional view taken on line 13-13 of FIG. 9.
Figure 14:
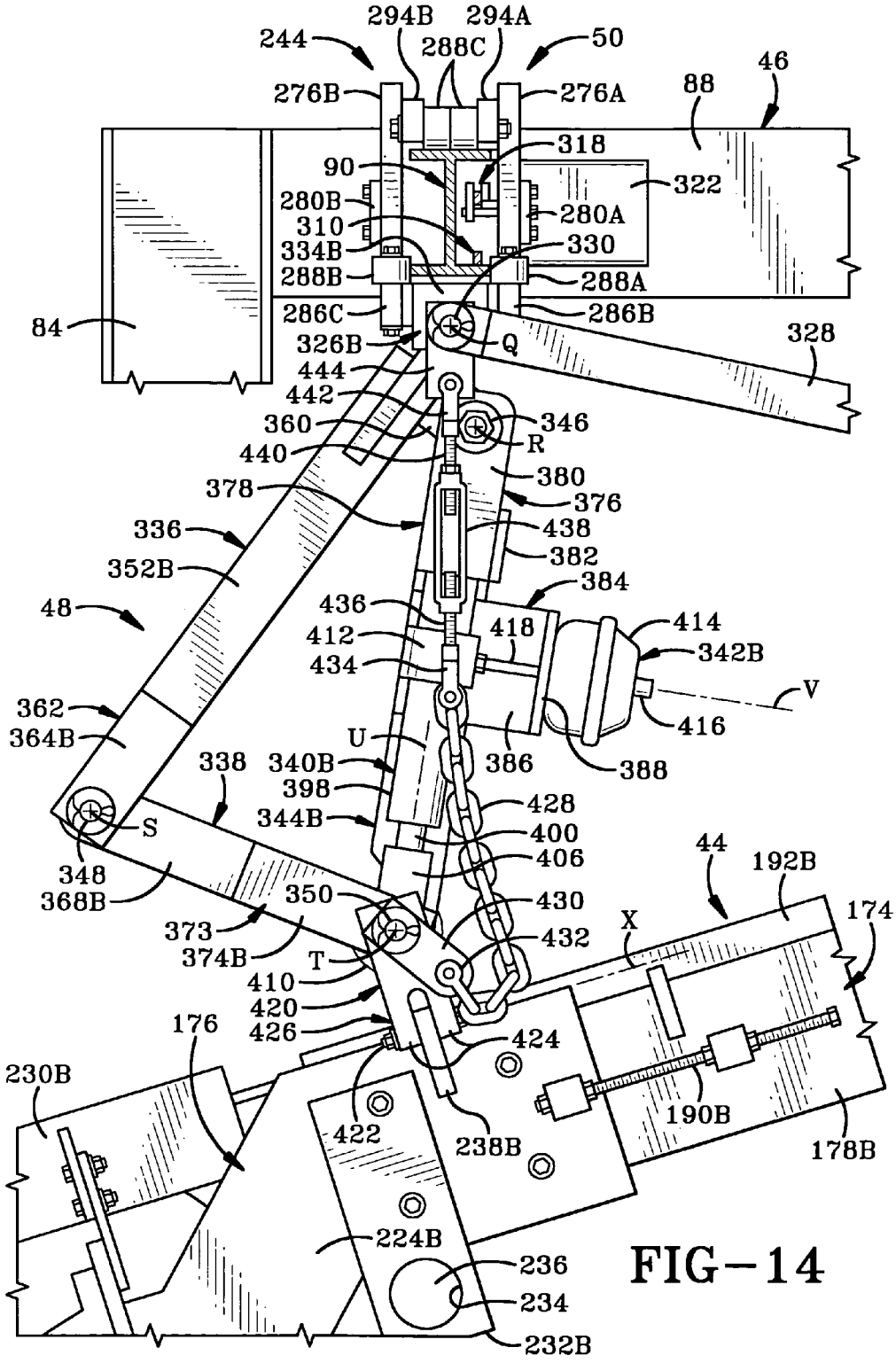
FIG. 14 is a sectional view taken on line 14-14 of FIG. 13.
Figure 15:
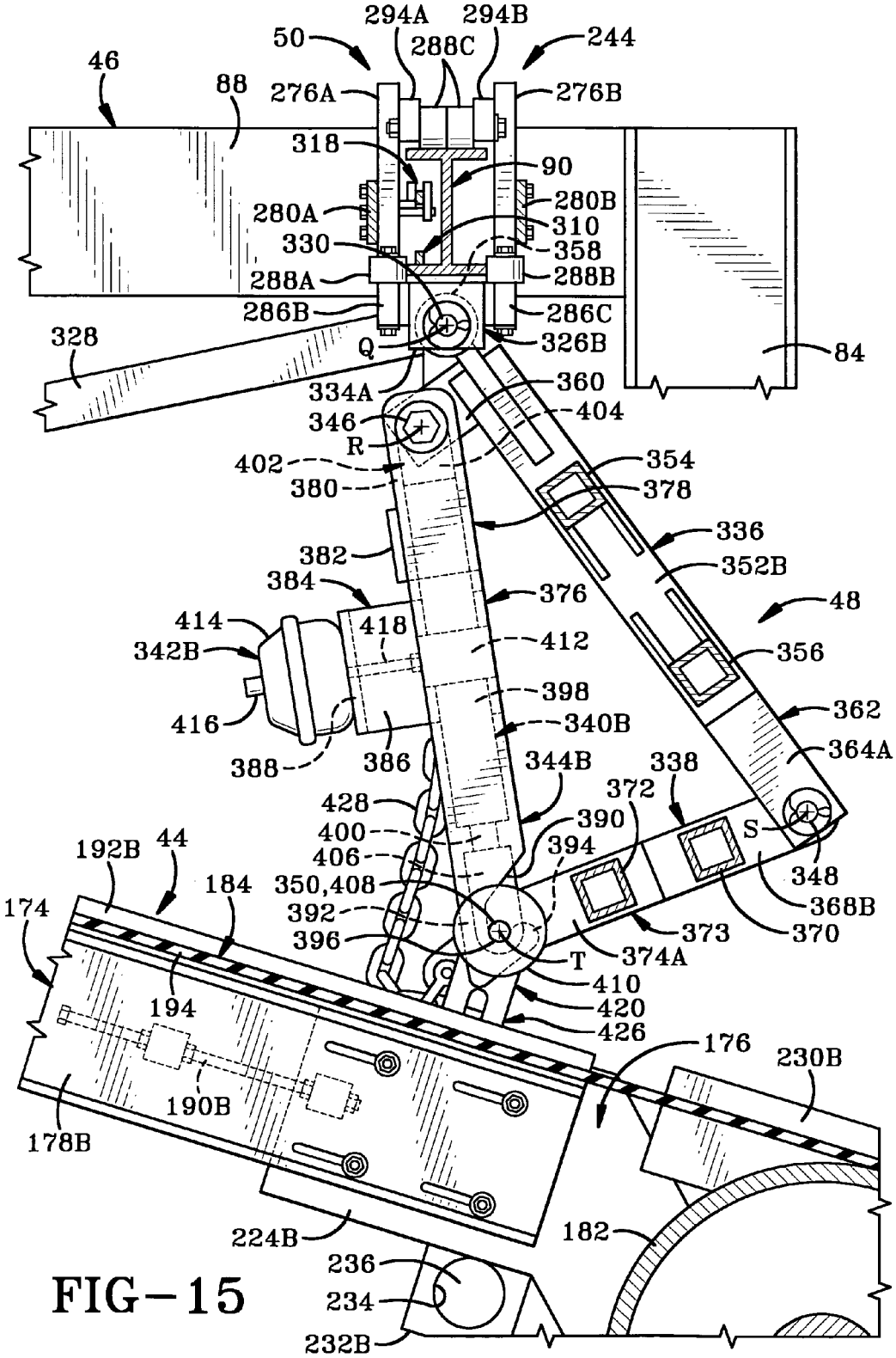
FIG. 15 is a sectional view taken on line 15-15 of FIG. 13 and shows one of the support posts seated within the notch of the hook member.

Rear suspension assembly 244 and conveyor lift 48 are now described in greater detail with primary reference to FIGS. 13-15. The upper portion of rear suspension assembly 244 is very similar to that of front suspension assembly 242 and thus includes many of the same structures such as uprights 276, crossbars 280, roller mounts 286, rollers 288, roller mounts 292 and so forth which form a rear rolling carriage which is driven by a rear drive assembly which is substantially the same as the front drive assembly and includes drive belt 310, sprockets 312, chain mounting bracket 318 and hydraulic motor 322. This rear carriage and rear drive mechanism thus drive the lateral back and forth movement (Arrow P in FIG. 13) of the rear portion of conveyor assembly 44 including lift 48. Unlike front suspension assembly 242, rear assembly 244 does not include the C-shaped or U-shaped structure which includes arms 246, 248 and 250 (FIG. 11). Instead, the lower ends of uprights 276 of rear assembly 244 are rigidly secured to left and right mounting blocks 326A and B. Rear assembly 244 is interconnected to front assembly 242 by a stabilizing tie bar 328 (best shown in FIG. 10) which extends adjacent and axially outward of side 172 of conveyor assembly 44 and which is pivotally connected at its rear end to mounting block 326B via a rear pivot 330 (FIGS. 10, 14 and 15) and is pivotally connected at its front end to the lower end of arm 250 at a front pivot 332 (FIG. 10).

With continued reference to FIGS. 13-15, each of mounting blocks 326 includes axially spaced legs 334A and B with respective holes formed therein for receiving therethrough rear pivot 330 which is secured by a cotter pin or the like. Rear assembly 244 and lift 48 include an upper pivoting member 336, a lower pivoting member 338, left and right hydraulic lift actuators 340A and B, left and right hook arm actuators 342A and B which in the exemplary embodiment are pneumatic actuators, and left and right hook arms 344A and B. Upper pivoting member 336 is pivotally mounted adjacent its upper end to each of mounting blocks 326A and 326B via respective pivots 330 about a horizontal axially extending axis Q. Each lift actuator 340 adjacent its upper end and each hook arm adjacent its upper end is pivotally connected to upper pivoting member 336 via respective pivots 346 about another horizontally axially extending axis R which is parallel to, adjacent and below axis Q. Lower pivoting member 338 is pivotally connected adjacent its rear upper end to upper pivoting member 336 adjacent its lower end at respective pivots 348 about an axis S which is parallel to, rearward of and below axes Q and R in the raised position of lift 48 and conveyor assembly 44 shown in FIGS. 13-15. Lower pivoting member 338 adjacent its front lower end is pivotally connected to each lift actuator 340 adjacent its lower end at respective pivots 350 about an axis T which is parallel to and below each of axes Q, R and S and forward of axis S in the raised position of lift 48.

Upper pivoting member 336 includes a left leg 352A (FIGS. 9, 13) extending above left side 170 of conveyor assembly 44. Upper pivoting member 336 likewise includes a right leg 252B (FIGS. 10 and 13-15) extending above right side 172 of conveyor assembly 44. Pivoting member 336 further includes upper and lower horizontal crossbars 354 and 356 which extend axially and are rigidly connected to each of legs 352A and B whereby member 336 forms a rigid rectangular structure with legs 352 extending upwardly above upper crossbar 354 from this rectangular structure and also downwardly below lower crossbar 356 from this rectangular structure. Each leg 352 includes a cylindrical collar 358 at its upper end through which pivot 330 passes whereby each leg 352 is pivotally mounted about axis Q. Member 336 further includes a mounting projection 360 which is rigidly connected to each leg 352 adjacent its upper end and below collar 358 and extends outwardly and forward therefrom. Each projection 360 defines a hole through which pivot 346 extends to provide the pivotal connection between legs 352 and the associated lift actuator 340 and hook arm 344. Each leg 352 adjacent its lower end has a mounting clevis 362 comprising left and right arms 364A (FIG. 15) and 364B (FIG. 14) which are axially spaced from one another. Each of arms 364 defines a hole for receiving therethrough pivot 348.

Lower pivoting member 338 includes left and right legs 368A (FIGS. 9,13) and 368B (FIGS. 10 and 13-15). Lower pivoting member 338 further includes a horizontal upper rear crossbar 370 and a parallel lower front crossbar 372 which are spaced from one another, and extend between and are rigidly connected to legs 368A and B to form a rectangular configuration with portions of legs 368 extending forward and rearward therefrom in opposite directions. The upper rear end of each leg 368 is received between arms 364A and B of clevis 362 and defines a hole through which pivot 348 extends to provide the pivotal connection at axis S. Each leg 368 includes at its forward lower end a mounting clevis 373 comprising left and right axially spaced arms 374A (FIGS. 13,15) and 374B (FIGS. 13,14).

Each hook arm 344 includes a primary arm 376 extending the entire length of hook arm 344 from a top end thereof to a bottom end thereof. Hook arm 344 includes a mounting clevis 378 at its upper end which includes an upper portion of primary arm 376, a short arm 380 which is axially spaced from arm 376 and a cross member or cross plate 382 which is rigidly connected to and extends between short arm 380 and primary arm 376 adjacent its upper end. Clevis 378 is U-shaped as viewed from above and opens rearwardly. Hook arm 344 further includes a mounting bracket 384 a short distance below short arm 380 and includes a first arm 386 which is rigidly connected to primary arm 376 and extends forward therefrom, and a second arm 388 rigidly connected to the front of first arm 386 at right angles thereto and extending axially therefrom. A rearwardly opening notch or slot 390 is formed in primary arm 376 adjacent its lower end and extends forward from the rear surface of arm 376 and generally downwardly so that arm 376 narrows to a neck 392 which bounds the front of slot 390. A hook 394 is connected to the lower end of neck 392 and extends rearwardly therefrom to define an upwardly facing seating surface 396 at the bottom of slot 390 and then extends upwardly to a terminal end which extends upwardly and rearwardly of surface 396. Hook 394 along its lower end has a downwardly facing guide surface 397 (FIG. 16) a portion of which is directly below seating surface 396 and which angles upwardly and rearwardly from adjacent the front of hook 394 to adjacent the rear of hook 394.

Each lift actuator 340 in the exemplary embodiment is a linear actuator in the form of a hydraulic piston cylinder combination which includes a cylinder 398 and a piston 400 slidably received within cylinder 396 and moveable in a linear fashion along an axis U (FIG. 14) which extends generally downwardly. A mounting clevis 402 (FIG. 15) is rigidly attached to the top of cylinder 398 and extends upwardly therefrom. Clevis 402 includes a pair of axially spaced arms 404 (FIG. 13) which have enlarged ends or collars which serve as spacers through which holes are defined respectively and receive therethrough a respective one of pivots 346. Arms 404 are received between short arm 380 and the upper portion of primary arm 376 which forms mounting clevis 378, while mounting projection 360 is received between arms 404. Thus, lift actuator 340 adjacent its upper end, hook arm 344 adjacent its upper end and upper pivoting member 336 adjacent its upper end are pivotable about axis R via a common pivot 346. An enlarged mounting head 406 is secured to the bottom of piston 406. Pivot 350 includes a support member in the form of an extension or post 408 which extends axially outwardly from head 406. A flat circular disk 410 is axially spaced from head 406 and is secured to and extends radially outwardly from post 408 adjacent its end. Post 408 is removably receivable within slot 390 and in the raised and secured position shown in FIGS. 13-15 is seated atop seating surface 396 between neck 392 and the upwardly extending terminal end of hook 394. In the raised position, cylinder 398 is substantially parallel to and adjacent primary arm 376 of hook arm 344 with an upper portion of cylinder 398 received in the space between short arm 380 and the upper portion of primary arm 376 forming part of clevis 378. A U-shaped bracket 412 is mounted on and extends around a central portion of cylinder 398.

Each pneumatic actuator 342 includes a housing 414 with an air entry/exit port 416 on its forward end. Each actuator 342 also includes a push rod 418 a portion of which extends rearwardly and external to housing 414 and a portion of which (not shown) extends through an opening in the rear of housing 414 and into the interior chamber thereof and is mounted on a flexible diaphragm which is movable in response to air pressure provided via port 416 from air compressor 58 (FIG. 2) via pneumatic lines which are not shown. Push rod 418 is thus linearly moveable back and forth along and axis V (FIG. 14) which is transverse to and generally perpendicular to axis U. A rear terminal end of push rod 418 abuts bracket 412. A suspension member or bar 420 is pivotally connected adjacent it upper end at pivot 350 which extends through a hole formed in bar 420. Bar 420 adjacent its lower end is pivotally mounted on upper mounting bracket 238 of conveyor assembly 44 about a pivot 422 which extends through holes formed in bracket 238 and the longitudinally spaced arms 424 of a mounting clevis 426 at the bottom of bar 420. The upper portion of mounting bracket 238 is thus received between arms 424 to form the pivotal connection about an axis X which is perpendicular to axis T and angles upwardly and forwardly. An actuator extension limiter is provided which limits the extension of actuators 340 and also serves to permit the pivotal movement of upper and lower pivoting members 336 and 338 when conveyor assembly 44 is raised and lowered. More particularly, this limiter includes a flexible but strong elongated member shown in the exemplary embodiment as a chain 428 extending upwardly from the lower end of conveyor assembly 44 on either side 170 and 172 thereof and suitable for supporting the lower end of assembly 44 in the lowered position. A lower end of chain 428 is secured to a mounting bar 430 via a clevis 432 pivotally connected to bar 430. Bar 430 is itself pivotally connected at an end opposite clevis 432 to pivot 350 axially outward of suspension bar 420. Chain 428 at its upper end is connected via a mounting clevis 434 to a lower externally threaded rod 436 of a turn buckle 438 having an upper threaded rod 440 which is pivotally connected via a mounting clevis 442 to an upper mounting bar 444 which is pivotally connected about pivot 330 and hangs downwardly therefrom. Thus, turn buckle 438 and chain 428 hangs downwardly from upper bar 444.

Thus, conveyor belt assembly 44 is in a raised and secured position shown in FIGS. 13-15. More particularly, each post 408 is seated within the respective slot 390 on seating surface 396 so that conveyor assembly 44 adjacent its lower end is supported on rear overhead beam 90 via the interconnection therebetween comprising a respective hook arm 344, the pivotal connection between hook arm 344 and mounting projection 360 of upper pivoting member 336 at pivot 346, and the pivotal connection of pivoting member 336 and the respective mounting block 326 via pivot 330, which is secured to or forms part of the rolling carriage of rear suspension assembly 244. When posts 408 are seated on seating surfaces 396, the weight of conveyor assembly 44 need not be supported by lift actuators 340. Vehicle 10 would thus ordinarily travel down the railway in this position when conveyor assembly 44 is not being used to pick up metallic objects from the railway bed. During the raising and lowering of conveyor assembly 44 described below, upper and lowering pivoting members 336 and 338 help to stabilize the pivotal movement primarily of lift 48 so that, for instance, each hook arm 344 pivots only along a vertical longitudinal plane. Each lift actuator 340 is also controlled in the same manner to pivot only long a vertical longitudinal plane. This is also true of housing 414 of each actuator 342 and each of legs 352 and 368 of pivoting members 336 and 338. This particular pivotal movement corresponds directly to the configuration of the pivotal connections at pivots 330, 346, 348 and 350, which allow only for pivotal movement about horizontal axially extending axes Q, R, S and T. The various mounting devises associated with these pivotal connections also facilitate the control of this pivotal movement.

Figure 16:
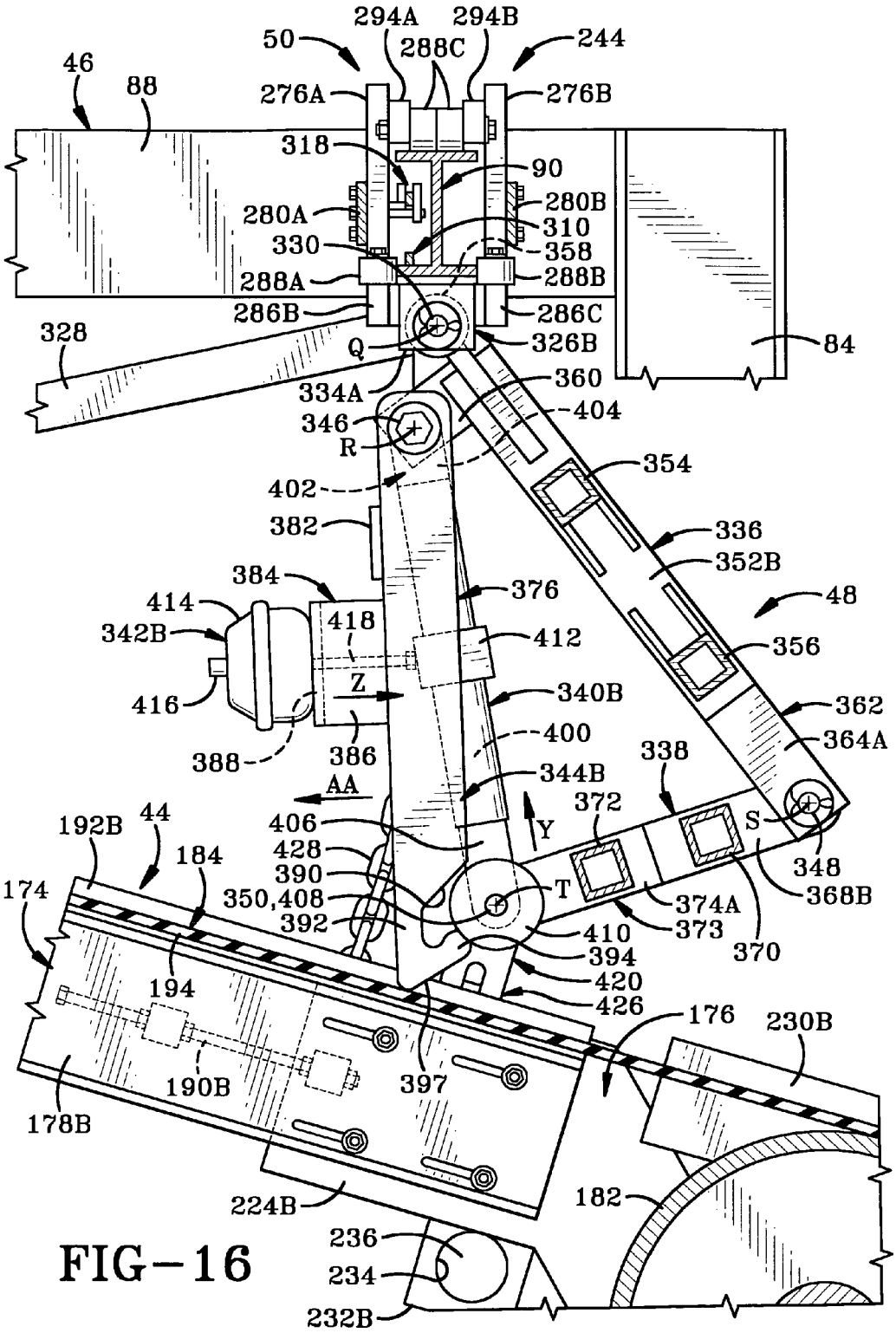
FIG. 16 is similar to FIG. 15 and shows the support post and hook member having moved relative to one another so that the support post is removed from within the notch of hook member.

The operation of conveyor lift 48 and related structures is now described with primary reference to FIGS. 16 and 17. In order to lower conveyor assembly 44, posts 408 must first be removed from slots 390 in order to eliminate the interference between each post 408 and hook 394 which prevents downward movement. To that effect, lift actuators 340 are actuated to retract pistons 400 and heads 406 upwardly (Arrow Y in FIG. 16) above the upwardly projecting terminal end of hook 394. Pneumatic actuators 342 are then operated to extend push rods 418 rearwardly (Arrow Z) against brackets 412 to cause pivotal movement of hook arms 344 about axis R and forward relative to each actuator 340 as indicated at Arrow AA in FIG. 16. Lift actuator 340 thus provides upward movement of post 408 and actuator 342 provides lateral movement of hook arm 344 in the longitudinal direction so that the rear end of hook 394 is moved forward of the respective post 408 so that post 408 may clear hooks 394 during downward movement. From the position shown in FIG. 16, lift actuators are then operated to extend pistons 400 and heads 406 so that posts 408 clear hooks 394 in order to lower conveyor assembly 44 (Arrow BB in FIG. 17) to its lowered operational position with conveyor belt 184 atop or a short distance above railway bed 12. Typically, roller 182 and the lowermost portion of belt 184 are positioned about an inch above the tie plates in the lowered position. During the lowering process, the lower end of upper pivoting member 336 pivots forward about pivots 330 while the upper end of lower pivoting member 338 pivots forward about pivots 350 as pivots 350 are lowered. After posts 408 have moved to a position at the height of or below the rear edges of hooks 394, the pressurization within actuators 342 which previously forced push rods 418 rearwardly may be released or reduced so that the lower ends of hook members 344 may pivot rearwardly about pivots 346 opposite that shown in FIG. 16 at Arrows AA. As previously noted, the downward movement of the rear lower end of conveyor assembly 44 is limited by the limiter, which includes chain 328, turn buckle 438 and the related structure which provides a stop to the downward movement when chain 328 becomes taut (FIG. 17). The degree of downward movement can be adjusted by rotating turn buckles 438 to shorten or lengthen the extension limiter.

Figure 19:
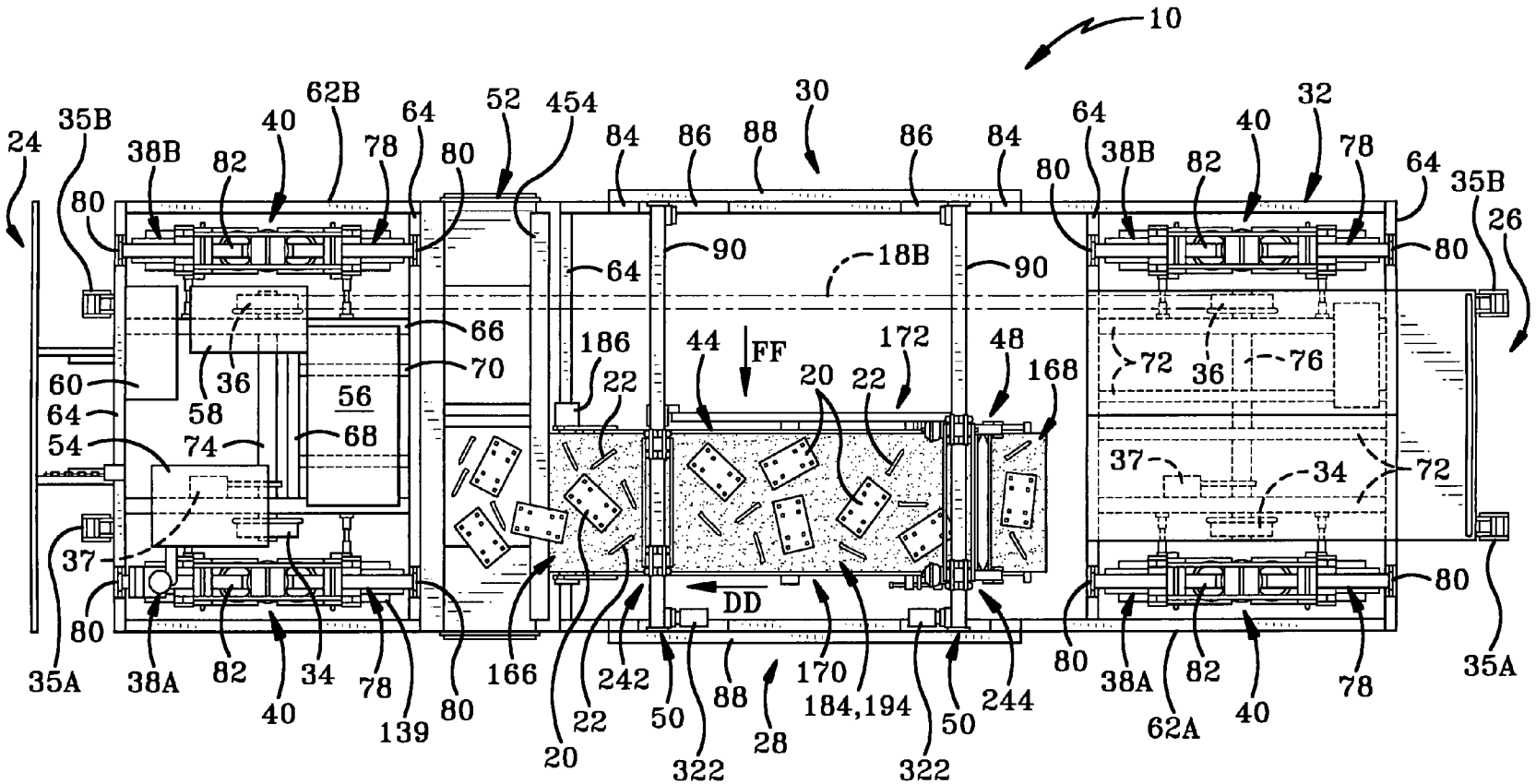
FIG. 19 is a top plan view of the operation shown in FIG. 18.
Figure 20:
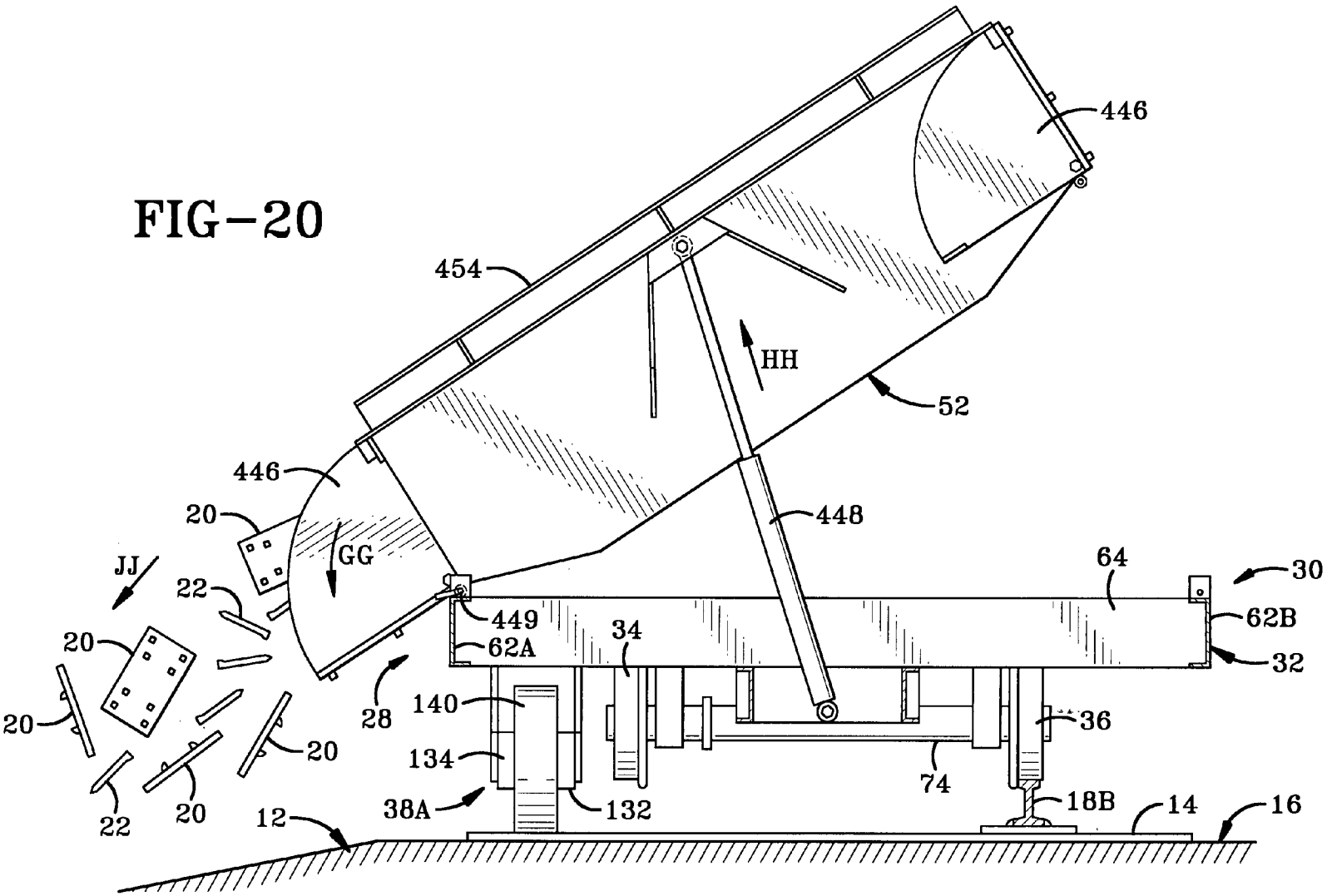
FIG. 20 is a sectional view showing the hopper being tilted to discharge the various metallic objects therefrom onto the ground.

The operation of vehicle 10 is further described with reference to FIGS. 18-20. FIGS. 18 and 19 show conveyor assembly 44 picking up metallic objects 20, 22 as vehicle 10 moves along the railway. FIG. 18 shows crawlers 38A on first side 28 of vehicle 10 in their lowered positions in contact with railway bed 12 and FIG. 19 shows the operational view from above with wheels 36 riding on rail 18B along side 30 of vehicle 10. With crawlers 38A in their lowered positions, the appropriate controls are operated to drive at least one crawler 38 to produce forward movement of vehicle 10 as indicated at Arrow CC in FIG. 18 while simultaneously motor 186 (FIG. 19) is operated to drive rotation of front roller 180 to drive the revolution of conveyor belt 184 about rollers 180 and 182 and to drive the rotation of roller 182. As shown in FIG. 18, rear roller 182 magnetically picks up metallic objects such as tie plate 20 via its magnetic field passing through conveyor belt 184 and moves the metallic objects to the top of upper segment 194, which moves along with the metallic objects upwardly and forward toward roller 180 as indicated at Arrow DD in FIGS. 18 and 19. Metallic objects 20 and 22 exit or fall off conveyor belt 184 forward of roller 180 and into hopper 52 as indicated at Arrow EE in FIG. 18. As desired, conveyor assembly 44 may be moved laterally as indicated at Arrow FF in FIG. 19 by operation of motors 322 of translator 50. This lateral movement thus moves conveyor assembly 44 transverse to rail 18B so that magnetic roller 182 can pick up the metallic objects from railway bed 12 in various locations. The lateral translation of conveyor assembly 44 may also involve the raising and lowering of the rear of assembly 44 with the use of lifts 48 as previously discussed. When it is desired to dump metallic objects 20 and 22 from hopper 52, one of a pair of doors 446 (FIG. 20) on either end of hopper 52 may be pivoted open about a pivot 449 (Arrow GG) and a hopper actuator 448 may be operated hydraulically to extend actuator 448 (Arrows HH) which tilts hopper 52 to dump objects 20 and 22 therefrom via the open doorway as indicated at Arrow JJ. Hopper 52 is configured to dump the metallic objects from either side of vehicle 10.

Figure 21:
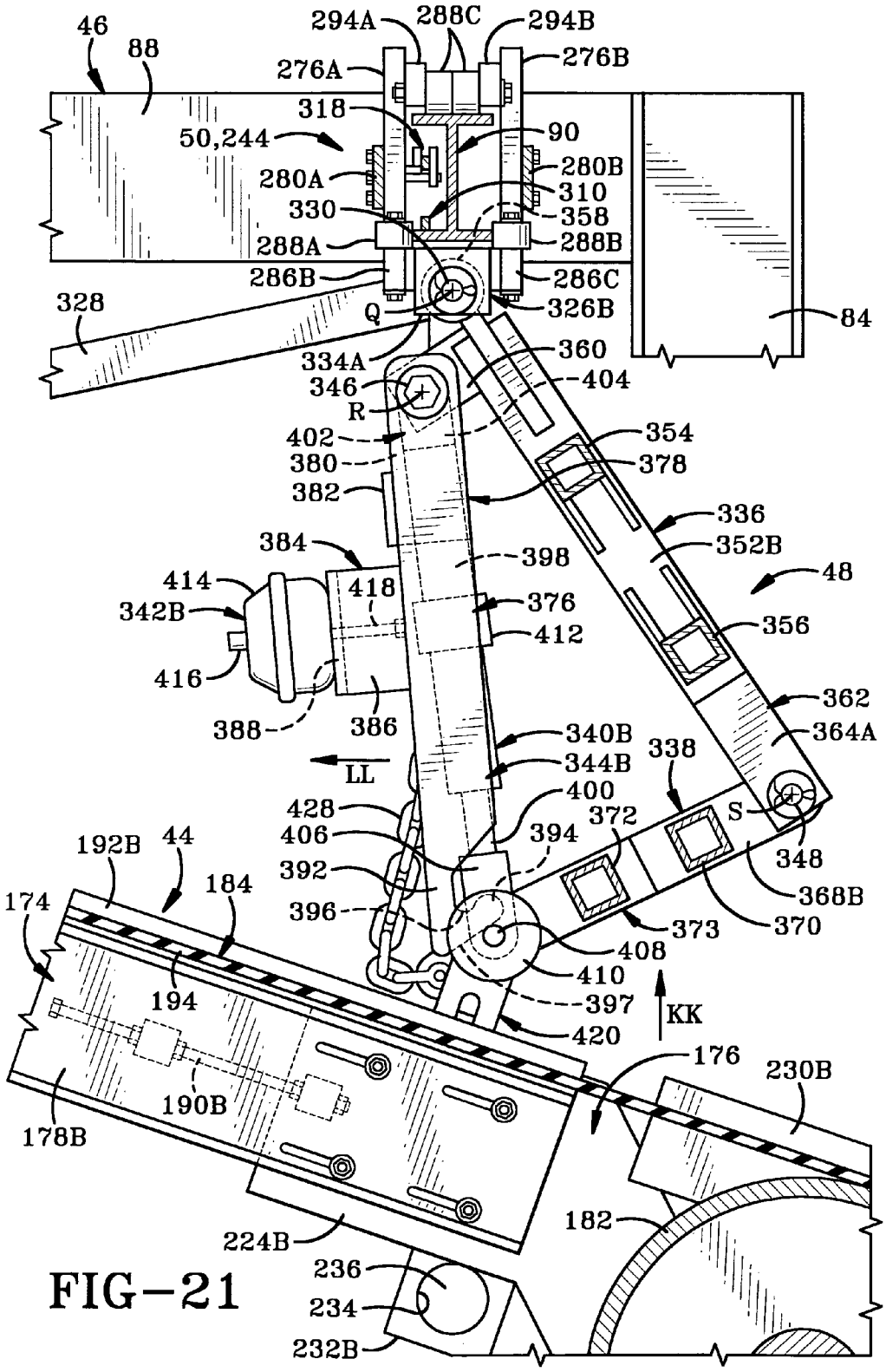
FIG. 21 is a sectional view similar to FIG. 15 showing the conveyor lift raising the conveyor and the support post slidably engaging the bottom of the hook member to pivot the hook member laterally relative to the support post and lift actuator.
Figure 22:
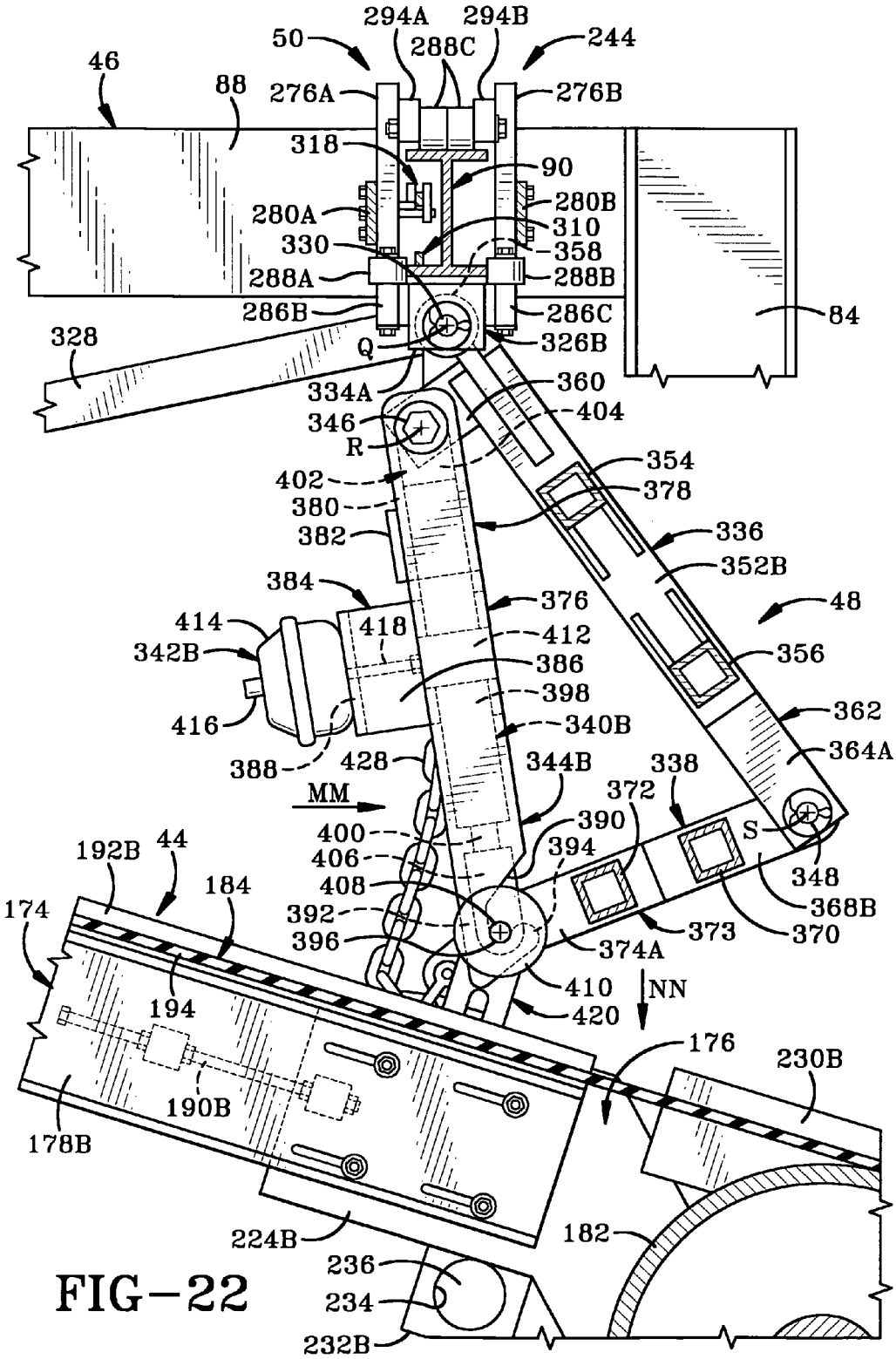
FIG. 22 is similar to FIG. 21 and shows the post member having moved back into its position seated within the notch of the hook member.

When the operation of magnetically picking up the metallic objects from railway bed 12 is completed, the rear end of the conveyor assembly 44 may be raised as indicated at Arrow KK in FIG. 21 by operation of actuators 340 to retract piston 400 and head 406 upwardly. If this upward movement is to continue to move conveyor assembly 44 to its raised and secured position shown in FIG. 22, hook member 344B must pivot forward as shown at Arrow LL about pivot 346 so that hook 394 may move out of the way of the upward travel of post 408. To that effect, the upward movement of post 408 during retraction of actuator 340 causes post 408 to slidingly engage guide surface 397 which forces the lower end of hook member 344 to move forward due to the cam effect of this sliding engagement. The continued upward movement of post 408 will force hook 394 to move forward sufficiently so that post 408 may move upwardly beyond the top of hook 394 and ultimately allow hook arm 344 to pivot back in the opposite direction as shown in Arrow MM in FIG. 22 so that post 408 moves back into slot 390 and then is lowered by actuator 340 (Arrows NN) so that post 408 is seated on seating surface 396. The rearward pivotal movement of hook 394 shown at Arrows MM occurs automatically once post 408 moves above hook 394 because the weight of conveyor assembly 44 biases actuator 340 and hook member 344 to their parallel positions of FIG. 22. With post 408 in the respective slot 390 on seating surface 396, conveyor assembly 44 is secured for travel along the railway without the support from hydraulic actuators 340.

Figure 23:
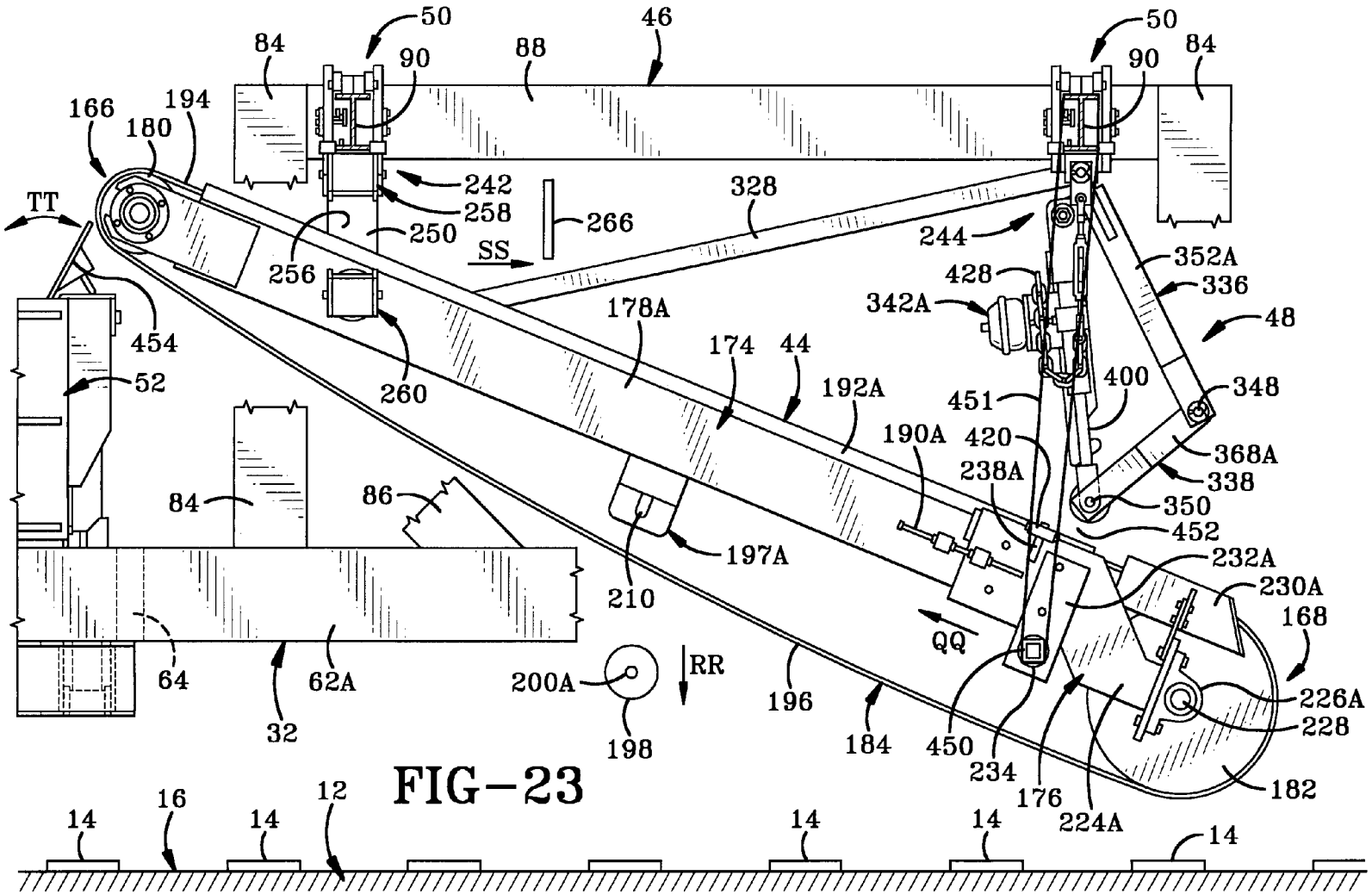
FIG. 23 is similar to FIG. 9 and shows the conveyor assembly being temporarily supported by the temporary support bar and temporary straps with various components being moved in preparation to remove the conveyor belt from the conveyor belt assembly.
Figure 24:
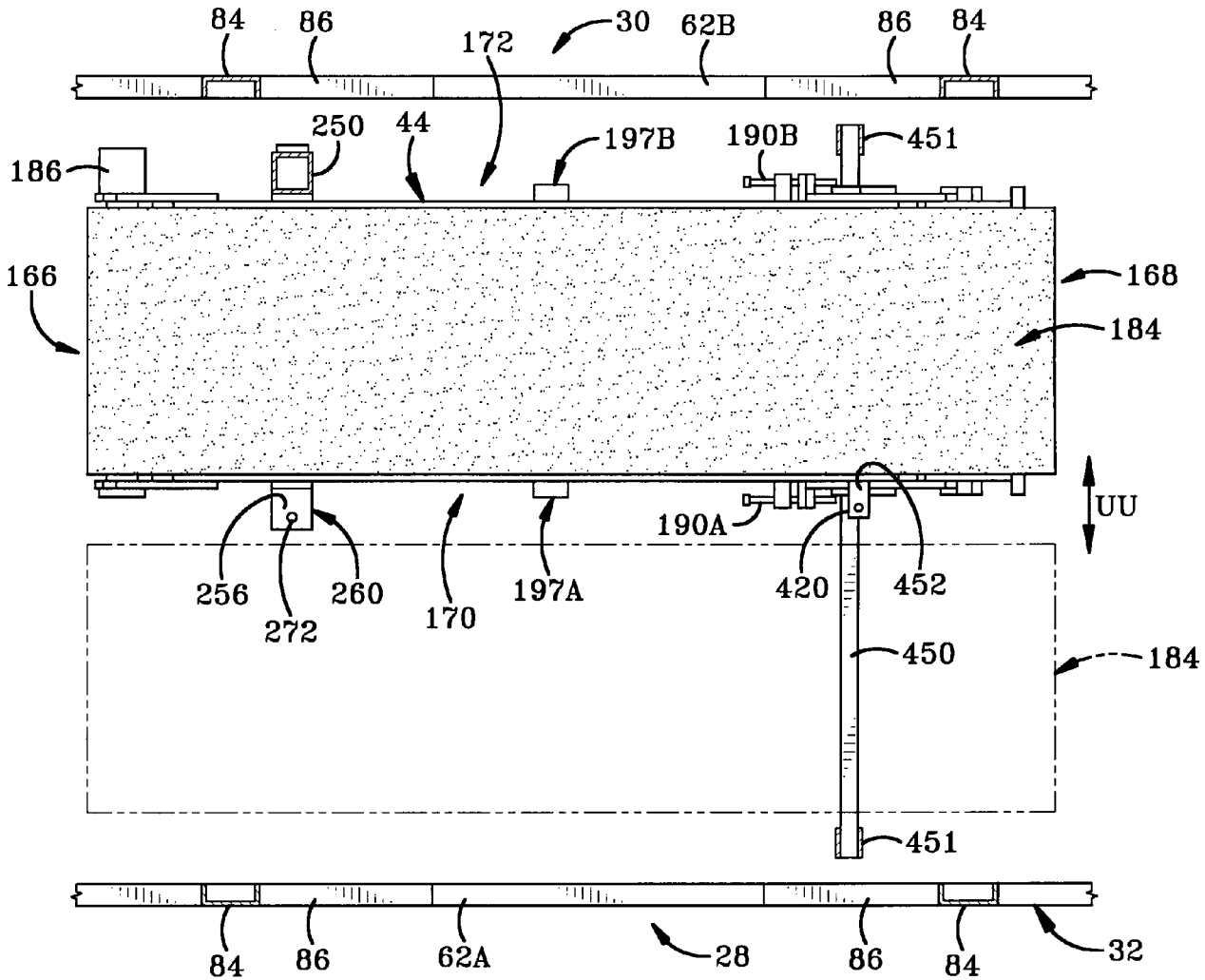
FIG. 24 is a sectional view of the configuration of FIG. 23 from above the conveyor belt assembly showing removal and installation of the conveyor belt.

In accordance with another feature of the invention and with reference to FIGS. 23 and 24, conveyor belt 184 may be removed from conveyor assembly 44 while maintaining the continuity of the continuous loop of belt 184. This is especially useful for the type of belt such as represented by belt 184 which is formed from a single continuous loop of material as opposed to a belt which has two terminal ends which are removably connected to one another to form the loop. In order to remove conveyor belt 184 from side 170 of conveyor assembly 44, several items must be moved out of the path of its removal. In addition, because conveyor assembly 44 is normally supported on overhead beams 90 solely by front and rear suspensions 242 and 244, conveyor assembly 44 must be otherwise supported during this process. Conveyor assembly 44 is moved out of its raised and secured position and lowered partially as represented in FIG. 23, and will have been moved generally to one side by translator 50 as indicated at FIG. 24.

To provide support to the lower rear end of conveyor assembly 44, a support pole or bar 450 is inserted axially through hole 234 of each of brackets 232 so that portions of bar 450 extend outwardly beyond both sides 170 and 172 of conveyor assembly 44. Pole 450 is thus inserted through the closed loop of belt 184 between its upper and lower segments, as well as through the closed loop of a replacement belt 184 positioned axially outward of side 170 of conveyor assembly 44, as indicated in phantom lines in FIG. 24. Support bar 450 is then itself supported by support members in the form of a pair of elongated flexible suspension members shown here in the form of straps 451. In the exemplary embodiment, straps 451 are configured to form a closed loop so that straps 451 loop below bar 450 and over rear beam 90 to hang downwardly therefrom. One of straps 451 is shown in FIG. 24 outward of side 172 of conveyor assembly 44 a relatively short distance. The other strap 451 is axially outward of side 170 in the opposite direction a greater distance. More particularly, the strap 451 toward the bottom of FIG. 24 and side 170 of assembly 44 define therebetween an axial distance which is greater than the axial width of belt 184 in order to accommodate belt 184 in the position shown in phantom.

Adjustment screws 190A and B are then rotated to move roller carriage 176 forward relative to main section 174 of assembly 44 (Arrow QQ in FIG. 23) to shorten assembly 44 and provide sufficient slack in belt 184 to clear guide rail 194A, belt guide 230A and bracket 197A. In addition, axle 200A is moved upwardly out of L-shaped slot 210 of bracket 197A so that roller 198 may be removed therefrom as well as from bracket 197B (FIG. 24) so that roller 198 is thus lowered out of the way (Arrow RR in FIG. 23). Further, suspension member 264 (FIG. 11A) must be removed to provide a pathway for the removal of belt 184. Thus, bolt 268 and nut 270 are loosened (FIG. 11A) so that bolt 268 may be removed to allow spacer 266 to be moved out of the way (Arrow SS in FIG. 23). With bolt 268 and spacer 266 removed, space 256 defined between upper and lower brackets 258 and 260 provides an open removal pathway for a portion of upper segment 194 of belt 184 to be removed from side 170.

With bolt 268 removed, the rigid connection between arm 250 and upper and lower arms 246 and 248 (FIG. 11) provides the support for the upper portion of conveyor assembly 44. Once bar 450 and straps 451 are supporting the lower end of conveyor assembly 44 and while chain 428 is slack, lower mounting bar 430 (FIG. 17) is removed from pivot 350 upon removal of the associated cotter pin and washer on pivot 350. Chain 428 may be conveniently looped over a portion of rear assembly 244 out of the way as shown in FIG. 23. Once bar 430 is removed, the upper end of suspension bar 420 is pivoted axially outwardly and downwardly about axis X (FIG. 14) to the position shown in FIGS. 23-24 and thus removed from pivot 350 in order to provide a space or belt removal pathway 452 between the lower end of lift 48 and conveyor assembly 44 along side 170 thereof.

In addition, a ramp 454 may need to be moved out of the way. Ramp 454 is in the exemplary embodiment pivotally mounted on hopper 52 so that its upper end pivots forward and rearward as shown at Arrow TT in FIG. 23. Ramp 454 facilitates the transfer of metallic objects from belt 184 into hopper 52 during operation. The standard ramps used with these types of vehicles are mounted on the upper front end of conveyor assembly 44 and must thus be removed in order to allow the removal of belt 184 from conveyor assembly 44. Ramp 454 may simply be pivoted forward on hopper 52 to provide any room needed to remove belt 184. While ramp 454 is in the exemplary embodiment pivotally mounted on hopper 52, it may also be rigidly mounted thereon. It is further noted that ramp 454 angles upwardly and rearwardly from its connection with hopper 52 and extends from adjacent one end of hopper 52 adjacent side 28 of vehicle 10 to adjacent the other end of hopper 52 adjacent the other side 30 of vehicle 10. Ramp 454 thus facilitates the transfer of metallic objects from belt 184 into hopper 52 regardless of the lateral position of conveyor assembly 44. In addition, ramp 454 is preferably positioned so that when conveyor assembly 44 is in its lowered position, ramp 454 is spaced forward of upper roller 180 and the portion of belt 184 engaging roller 180 (FIGS. 17, 23) so that hopper 52 may be tilted to discharge metallic objects therefrom (FIG. 20) without moving ramp 454 or conveyor assembly 44. It is further noted that when conveyor assembly 44 is its raised position, its front end abuts ramp 454 due to the weight shift which conveyor assembly 44 undergoes from the lowered position to the raised position and which causes a forward shift of conveyor assembly 44.

Once the various obstacles to the removal of belt 184 are overcome as noted above, belt 184 may simply be removed from conveyor assembly 44 and another belt 184 installed (Arrow UU) as shown in the alternate positions of belt 184 in solid lines and phantom lines in FIG. 24. Thus, during removal of belt 184 or installation of a new belt 184, a portion of the belt passes between upper roller 180 and ramp 454, a portion of upper segment 194 passes through space or pathway 256, another portion of upper segment 194 passes through space or pathway 452 and the central portion of lower segment 196 passes beneath roller bracket 197A. 15 After removal and installation, the various connections are then re-formed along side 170 of conveyor assembly 44 in order to put conveyor assembly 44 in an operational position suspended via assemblies 242 and 244. When conveyor assembly 44 is again supported by assemblies 242 and 244, pole or bar 450 is removed from holes 234 and from within the closed loop of the installed and removed belts 184, and straps 451 are removed and stored for later use. While the lower end of conveyor assembly 44 may be supported other than with the use of bar 450 and straps 451 during the removal and installation of belt 184, this method provides a simple and low cost process which eliminates the use of jacks or the like and which may be easily utilized in the field along the railway bed if necessary. The use of bar 450 and straps 451 thus allows for the removal and installation of belt 184 while conveyor assembly 44 is suspended from overhead beam 90 and thus supported solely by the frame of vehicle 10 itself.

Figure 25:
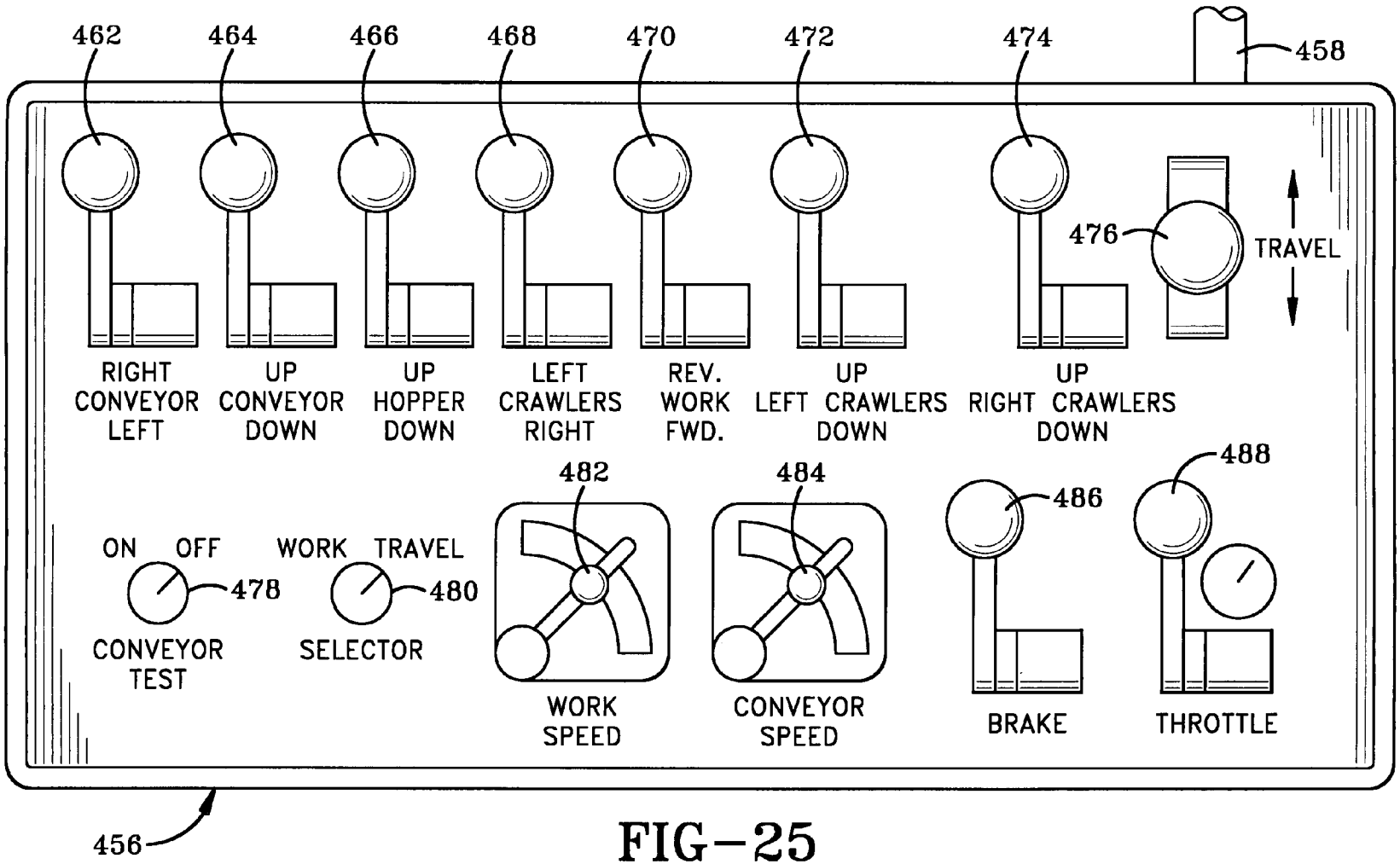
FIG. 25 is a diagrammatic view of the remote control.

Another feature of the invention is the ability to control the various operations of vehicle 10 with a remote control 456 which is shown in FIG. 25. Remote control 456 includes a radio frequency (RF) transmitter and an antenna 458 for transmitting RF signals to an RF receiver 460 (FIG. 1) on vehicle 10. Remote control 456 is thus in wireless communication with receiver 460, which is in electrical communication with the controls which are used to operate the hydraulic system and pneumatic system including pump 56, compressor 58 and the various hydraulic and pneumatic valves and electrical switches associated with the related operations. In the exemplary embodiment, numerous manually operable controls are mounted on the housing of remote control 456 each of which is operable to send RF signals via an antenna 58 to receiver 460. More particularly, these controls include a traverse control 462, a conveyor lift control 464, a hopper actuator control 466, a crawler selector control 468, a work direction control 470, a first or left crawler lift control 472, a second or right crawler lift control 474, a travel direction control 476, a conveyor test or conveyor on/off switch 478, a work/travel selector 480, a work speed control 482, a conveyor speed control 484, a brake control 486, and a throttle control 488.

Many of these controls have three positions or are 3-way switches having a neutral position. Traverse control 462 has a first position for sending an RF signal to control hydraulic motors 322 (FIGS. 2, 10) to cause translator 50 to traverse or move conveyor assembly 44 to the right of vehicle 10. Control 462 also has a second or left position for moving conveyor assembly 44 to the left as well as a neutral position in which motors 322 cease rotation so that no lateral movement of conveyor assembly 44 occurs. Similarly, conveyor lift control 464 has an up or raising position, a down or lowering position and a neutral position for respectively raising, lowering and maintaining the rear end of conveyor assembly 44 at a given position. Control 464 thus sends respective RF signals for controlling hydraulic actuators 340 (FIGS. 9, 10, 13, 14) of lift 48 for raising and lowering the rear end of conveyor assembly 44. Control 464 or a similar control may also operate pneumatic actuators 342 in accordance the previous discussion of their operation. Control 466 also has three positions for respectively raising, lowering and maintaining hopper 52 at a given position via control of actuator 448 (FIG. 20). Control 468 also has three positions for selecting which crawlers 38A or 38B (FIG. 2), if any, are to be operated for moving vehicle 10 at a work speed. Control 470 has three positions for respectively controlling whether the crawlers 38 selected by control 468 will operate in reverse, forward or neutral via operation of drive motor 139 (FIG. 3). Control 472 is configured for controlling the raising and lowering of left crawlers 38A by controlling the air pressure in air springs 142 and 144 via air inlet and outlet valves 148 and 152 (FIGS. 3-5). Control 474 serves the same purpose as control 472 for right crawlers 38B. Control 476 is used to control the forward and reverse direction travel of vehicle 10 by controlling wheel drive motors 37 (FIG. 2) to control the forward or reverse rotation of wheels 34, 36, and also includes a neutral position. Control or switch 478 is used to test the operation of conveyor assembly 44 and/or control the overall power to the other controls which operate the movement of conveyor assembly 44 and belt 184. Control 480 is a selector switch for selecting whether vehicle 10 will be used in a work mode in which its travel along the railway is driven by one set of crawlers 38A or 38B, or whether vehicle 10 will be operated in a travel mode in which the travel of vehicle 10 along the railway is driven by wheel drive motors 37 and wheels 34 or 36. Control 482 is used to control the speed with which the selected crawlers 38 are driven when selector 480 is in the work mode position. Control 484 is used to control the speed with which conveyor belt 184 revolves on assembly 44 and thus more particularly controls the rate of motor 186 (FIG. 2). Brake control 486 is used to apply or disengage the brakes of vehicle 10 for respectively stopping or allowing movement of vehicle 10 along the railway whether in the work or travel mode. Throttle control 488 is used to control the rate of operation of engine 54 (FIGS. 1-2).

Remote control 456 is particularly handy due to the fact that some of the metallic objects along railway bed 12 are not picked up by the magnetic roller 182. Thus, the operator or another worker will walk along the railroad track following vehicle 10 during its work mode of picking up the metallic objects. The operator or other worker will thus pick up any metallic objects which were not picked up by vehicle 10 and place them in hopper 52. Sometimes this is simply a matter of picking up a loose metallic object. However, the various metallic objects may also become stuck along the track or it is possible that a railroad spike was not completely removed so that the operator or worker will have to remove the spike with hand tools. Thus, remote control 456 may be used to stop vehicle 10 to permit the operator or other worker time to take care of this task without vehicle 10 continuing along the railroad track.

Remote control 456 thus provides for remotely controlling the multiple features discussed above so that the operator of vehicle 10 need not be on the vehicle itself during these various operations. Remote control 456 also serves to represent the controls which are typically within cabin 42 (FIG. 1) of vehicle 10. Thus, vehicle 10 may also be controlled by an operator within cabin 42 in the same manner as with remote control 456 except for without the use of the wireless aspect of the control.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An apparatus for traveling along a railway bed having first and second railroad rails, the apparatus comprising:

a frame;

a first set of rail engaging wheels mounted on the frame and adapted to ride on the first rail;

a second set of rail engaging wheels mounted on the frame and adapted to ride on the second rail;

a crawler adapted to support the frame for travel along the railway bed when one of the rails is removed from the railway bed;

a carriage which carries the crawler;

a lowered position of the carriage in which the crawler is adapted to contact the railway bed;

a raised position of the carriage in which the crawler is adapted to be out of contact with the railway bed;

a first pneumatic lift mounted on the frame for raising the carriage from the lowered position to the raised position; wherein the first pneumatic lift is directly above the crawler in the lowered and raised positions; and a first elastomeric bladder which extends between the frame and carriage and defines an interior chamber for receiving a gas for inflation and deflation of the first bladder; wherein the carriage is movable relative to the frame in response to inflation of the first bladder.

2. The apparatus of claim 1 further comprising a slide surface on the frame which the carriage slidably engages during movement between the lowered and raised positions.

3. The apparatus of claim 1 further comprising a roller rotatably mounted on one of the carriage and the frame; and a rolling engagement between the roller and the other of the carriage and frame during movement between the lowered and raised positions.

4. The apparatus of claim 1 further comprising a remote control in wireless communication with the pneumatic lift to remotely control its operation.

5. The apparatus of claim 1 further comprising a second elastomeric bladder which extends between the frame and carriage and defines an interior chamber for receiving a gas for inflation and deflation of the second bladder;

wherein the carriage is movable upwardly relative to the frame in response to inflation of the first bladder; and the carriage is movable downwardly relative to the frame in response to inflation of the second bladder.

6. An apparatus for traveling along a railway bed having first and second railroad rails, the apparatus comprising:

a frame;

a first set of rail engaging wheels mounted on the frame and adapted to ride on the first rail;

a second set of rail engaging wheels mounted on the frame and adapted to ride on the second rail;

a crawler adapted to support the frame for travel along the railway bed when one of the rails is removed from the railway bed;

a carriage which carries the crawler;

a lowered position of the carriage in which the crawler is adapted to contact the railway bed;

a raised position of the carriage in which the crawler is adapted to be out of contact with the railway bed;

a first pneumatic lift mounted on the frame for raising the carriage from the lowered position to the raised position; wherein the first pneumatic lift is directly above the crawler in the lowered and raised positions; and a first air spring on the first pneumatic lift having a lower end seated on the frame and an upper end mounted on the carriage.

7. An apparatus for traveling along a railway bed having first and second railroad rails, the apparatus comprising:

a frame;

a first set of rail engaging wheels mounted on the frame and adapted to ride on the first rail;

a second set of rail engaging wheels mounted on the frame and adapted to ride on the second rail;

a crawler adapted to support the frame for travel along the railway bed when one of the rails is removed from the railway bed;

a carriage which carries the crawler;

a lowered position of the carriage in which the crawler is adapted to contact the railway bed;

a raised position of the carriage in which the crawler is adapted to be out of contact with the railway bed;

a first pneumatic lift mounted on the frame for raising the carriage from the lowered position to the raised position;

a first air spring on the first pneumatic lift having a lower end seated on the frame and an upper end mounted on the carriage; and a second air spring having a lower end seated on the carriage and an upper end mounted on the frame.

8. An apparatus for traveling along a railway bed having first and second railroad rails, the apparatus comprising:

a frame;

a first set of rail engaging wheels mounted on the frame and adapted to ride on the first rail;

a second set of rail engaging wheels mounted on the frame and adapted to ride on the second rail;

a crawler adapted to support the frame for travel along the railway bed when one of the rails is removed from the railway bed;

a carriage which carries the crawler;

a lowered position of the carriage in which the crawler is adapted to contact the railway bed;

a raised position of the carriage in which the crawler is adapted to be out of contact with the railway bed;

a first pneumatic lift mounted on the frame for raising the carriage from the lowered position to the raised position; wherein the first pneumatic lift is directly above the crawler in the lowered and raised positions; and a second pneumatic lift mounted on the carriage for supporting the frame on the carriage.

9. An apparatus for traveling along a railway bed having first and second railroad rails, the apparatus comprising:

a frame;

a first set of rail engaging wheels mounted on the frame and adapted to ride on the first rail;

a second set of rail engaging wheels mounted on the frame and adapted to ride on the second rail;

a crawler adapted to support the frame for travel along the railway bed when one of the rails is removed from the railway bed;

a carriage which carries the crawler;

a lowered position of the carriage in which the crawler is adapted to contact the railway bed;

a raised position of the carriage in which the crawler is adapted to be out of contact with the railway bed;

a first pneumatic lift mounted on the frame for raising the carriage from the lowered position to the raised position; wherein the first pneumatic lift is directly above the crawler in the lowered and raised positions; and a slide surface on the frame which the carriage slidably engages during movement between the lowered and raised positions; wherein the carriage pivots about the slide surface during movement between the lowered and raised positions.

10. An apparatus for traveling along a railway bed having first and second railroad rails, the apparatus comprising:

a frame;

a first set of rail engaging wheels mounted on the frame and adapted to ride on the first rail;

a second set of rail engaging wheels mounted on the frame and adapted to ride on the second rail;

a crawler adapted to support the frame for travel along the railway bed when one of the rails is removed from the railway bed;

a carriage which carries the crawler;

a lowered position of the carriage in which the crawler is adapted to contact the railway bed;

a raised position of the carriage in which the crawler is adapted to be out of contact with the railway bed;

a first pneumatic lift mounted on the frame for raising the carriage from the lowered position to the raised position;

a tie rod;

a first pivotal connection between the tie rod and the frame; and a second pivotal connection between the tie rod and the carriage; wherein the first and second pivotal connections define therebetween a distance which is fixed during movement of the carriage from the lowered position to the raised position.

11. An apparatus for traveling along a railway bed having first and second railroad rails, the apparatus comprising:

a frame;

a first set of rail engaging wheels mounted on the frame and adapted to ride on the first rail;

a second set of rail engaging wheels mounted on the frame and adapted to ride on the second rail;

a crawler adapted to support the frame for travel along the railway bed when one of the rails is removed from the railway bed;

a carriage which carries the crawler;

a lowered position of the carriage in which the crawler is adapted to contact the railway bed;

a raised position of the carriage in which the crawler is adapted to be out of contact with the railway bed;

a first lift mounted on the frame for raising the carriage from the lowered position to the raised position;

a conveyor belt assembly having first and second opposed ends;

a conveyor belt which forms a closed loop and is revolvably mounted on the conveyor belt assembly circumscribing the first and second ends;

a support structure mounted on the frame above the conveyor belt assembly; and a plurality of suspension members connected to and extending downwardly from the support structure and connected to the conveyor belt assembly whereby the conveyor belt assembly is supported entirely by the support structure via the suspension members.

12. The apparatus of claim 11 further comprising first and second ends on the frame defining therebetween a longitudinal direction in which the apparatus travels on its wheels; first and second sides on the frame defining therebetween an axial direction; wherein the first and second ends of the conveyor belt assembly ends are longitudinally spaced from one another; and a lateral translator for moving the conveyor belt assembly back and forth in the axial direction.

13. An apparatus for traveling along a railway bed having first and second railroad rails, the apparatus comprising:

a frame;

a first set of rail engaging wheels mounted on the frame and adapted to ride on the first rail;

a second set of rail engaging wheels mounted on the frame and adapted to ride on the second rail;

a crawler adapted to support the frame for travel along the railway bed when one of the rails is removed from the railway bed;

a carriage which carries the crawler;

a lowered position of the carriage in which the crawler is adapted to contact the railway bed;

a raised position of the carriage in which the crawler is adapted to be out of contact with the railway bed;

a first lift mounted on the frame for raising the carriage from the lowered position to the raised position;

a conveyor belt assembly having first and second opposed ends and first and second opposed sides each extending between the first and second ends;

a conveyor belt which forms a closed loop and is revolvably mounted on the conveyor belt assembly circumscribing the first and second ends;

a first support structure mounted on the frame above the conveyor belt assembly;

first and second suspension members extending between and connected to the support structure and conveyor belt assembly respectively on the first and second sides of the conveyor belt assembly;

a first position of the first suspension member which interferes with removal of the conveyor belt from the first side of the conveyor belt assembly while maintaining continuity of the conveyor belt loop;

a second position of the first suspension member which does not interfere with removal of the conveyor belt from the first side of the conveyor belt assembly while maintaining continuity of the conveyor belt loop; and wherein the conveyor belt is removable from the first side of the conveyor belt assembly while maintaining continuity of the conveyor belt loop when the first suspension member is in the second position.

14. The apparatus of claim 13 further comprising upper and lower segments on the conveyor belt extending from the first end to the second end; a lower surface on the lower segment; a support roller which abuts the lower surface during revolution of the conveyor belt; a first releasable connection between the support roller and the conveyor belt assembly on the first side of the conveyor belt assembly; a connected state of the first connection which interferes with removal of the conveyor belt from the first side of the conveyor belt assembly while maintaining continuity of the conveyor belt loop; a released state of the first connection which does not interfere with removal of the conveyor belt from the first side of the conveyor belt assembly while maintaining continuity of the conveyor belt loop; and a second connection between the support roller and the conveyor belt assembly on the second side of the conveyor belt assembly.

15. The apparatus of claim 13 further comprising a support bar having a supporting position mounted on the conveyor belt assembly for supporting the assembly when the first suspension member is in the second position and a non-supporting position removed from the conveyor belt assembly; and wherein the conveyor belt is removable from the first side of the conveyor belt assembly while maintaining continuity of the conveyor belt loop when the support bar is in the supporting position.

16. An apparatus for traveling along a railway bed having first and second railroad rails, the apparatus comprising:

a frame;

a first set of rail engaging wheels mounted on the frame and adapted to ride on the first rail;

a second set of rail engaging wheels mounted on the frame and adapted to ride on the second rail;

a crawler adapted to support the frame for travel along the railway bed when one of the rails is removed from the railway bed;

a carriage which carries the crawler;

a lowered position of the carriage in which the crawler is adapted to contact the railway bed;

a raised position of the carriage in which the crawler is adapted to be out of contact with the railway bed;

a first lift mounted on the frame for raising the carriage from the lowered position to the raised position;

a conveyor belt assembly movable between a raised position and a lowered position;

a support structure mounted on the frame above the conveyor belt assembly;

a conveyor lift;

a first pivoting member pivotally connected to the support structure and extending downwardly therefrom;

a second pivoting member pivotally connected to the first pivoting member; and a first actuator pivotally connected to the first and second pivoting members for raising the conveyor belt assembly from the lowered position to the raised position.

17. The apparatus of claim 16 further comprising a support member mounted on the conveyor belt assembly; and a hook member on the lift having an upwardly facing seating surface on which the support member is removably seated to support the conveyor belt assembly in the raised position.

18. The apparatus of claim 17 further comprising a second actuator on the lift for removing the support member from the seating surface.

19. The apparatus of claim 17 further comprising a downwardly facing guide surface on the hook which is below the seating surface and which angles upwardly; and a sliding engagement between the support member and the guide surface during upward movement of the support member which causes relative lateral movement between the hook member and support member.

20. An apparatus for traveling along a railway bed having first and second railroad rails, the apparatus comprising:

a frame;

a first set of rail engaging wheels mounted on the frame and adapted to ride on the first rail;

a second set of rail engaging wheels mounted on the frame and adapted to ride on the second rail;

a crawler;

a carriage which carries the crawler;

a lowered position of the carriage in which the crawler is adapted to contact the railway bed;

a raised position of the carriage in which the crawler is adapted to be out of contact with the railway bed;

a first upright of the carriage which is vertical in the lowered and raised positions;

a sliding engagement between the first upright of the carriage and the frame during movement between the lowered and raised positions;

a first vertically elongated through opening formed in the first upright; and a horizontal beam of the frame which passes through the first through opening so that the carriage is vertically slidable relative to the horizontal beam of the frame with the horizontal beam of the frame within the first vertically elongated through opening.

21. The apparatus of claim 20 further comprising a first pneumatic lift which is directly above the crawler in the lowered and raised positions.

22. The apparatus of claim 20 further comprising front and rear ends on the frame defining therebetween a longitudinal direction in which the apparatus travels on its wheels; wherein the horizontal beam is a longitudinal beam of the frame; and wherein the sliding engagement is between the first upright of the carriage and the longitudinal beam of the frame.

23. The apparatus of claim 20 further comprising a second upright of the carriage which is spaced from the first upright and is vertical in the lowered and raised positions;

a second vertically elongated through opening formed in the second upright; and wherein the horizontal beam of the frame passes through the second through opening so that the carriage is vertically slidable relative to the horizontal beam of the frame with the horizontal beam of the frame within the second vertically elongated through opening.

24. The apparatus of claim 20 further comprising a first elastomeric bladder which extends between the horizontal beam and carriage and defines an interior chamber for receiving a gas for inflation and deflation of the first bladder;

wherein the carriage is movable relative to the frame in response to inflation of the first bladder.

25. An apparatus for traveling along a railway bed having first and second railroad rails, the apparatus comprising:

a frame;

a first set of rail engaging wheels mounted on the frame and adapted to ride on the first rail;

a second set of rail engaging wheels mounted on the frame and adapted to ride on the second rail;

a crawler;

a carriage which carries the crawler;

a lowered position of the carriage in which the crawler is adapted to contact the railway bed;

a raised position of the carriage in which the crawler is adapted to be out of contact with the railway bed;

a roller on one of the carriage and the frame;

a rolling engagement between the roller and the other of the carriage and frame during movement between the lowered and raised positions; and a first elastomeric bladder which extends between the frame and carriage and defines an interior chamber for receiving a gas for inflation and deflation of the first bladder; wherein the carriage is movable relative to the frame in response to inflation of the first bladder.

26. The apparatus of claim 25 further comprising a second elastomeric bladder which extends between the frame and carriage and defines an interior chamber for receiving a gas for inflation and deflation of the second bladder;

wherein the carriage is movable upwardly relative to the frame in response to inflation of the first bladder; and the carriage is movable downwardly relative to the frame in response to inflation of the second bladder.

27. An apparatus for traveling along a railway bed having first and second railroad rails, the apparatus comprising:

a frame;

a first set of rail engaging wheels mounted on the frame and adapted to ride on the first rail;

a second set of rail engaging wheels mounted on the frame and adapted to ride on the second rail;

a crawler adapted to support the frame for travel along the railway bed when one of the rails is removed from the railway bed;

a carriage which carries the crawler;

a lowered position of the carriage in which the crawler is adapted to contact the railway bed;

a raised position of the carriage in which the crawler is adapted to be out of contact with the railway bed;

a first pneumatic lift mounted on the frame for raising the carriage from the lowered position to the raised position;

upper and lower ends on the first pneumatic lift; and wherein the upper end is directly above the lower end in the lowered and raised positions; and a first elastomeric bladder which extends between the frame and carriage and defines an interior chamber for receiving a gas for inflation and deflation of the first bladder; wherein the carriage is movable relative to the frame in response to inflation of the first bladder.

28. The apparatus of claim 27 further comprising a second elastomeric bladder which extends between the frame and carriage and defines an interior chamber for receiving a gas for inflation and deflation of the second bladder;

wherein the carriage is movable upwardly relative to the frame in response to inflation of the first bladder; and the carriage is movable downwardly relative to the frame in response to inflation of the second bladder.

29. An apparatus for traveling along a railway bed having first and second railroad rails, the apparatus comprising:

a frame;

a first set of rail engaging wheels mounted on the frame and adapted to ride on the first rail;

a second set of rail engaging wheels mounted on the frame and adapted to ride on the second rail;

a crawler adapted to support the frame for travel along the railway bed when one of the rails is removed from the railway bed;

a carriage which carries the crawler;

a lowered position of the carriage in which the crawler is adapted to contact the railway bed;

a raised position of the carriage in which the crawler is adapted to be out of contact with the railway bed;

a first pneumatic lift mounted on the frame for raising the carriage from the lowered position to the raised position; and a first upright of the carriage which is vertical in the lowered and raised positions; wherein the first upright pivots during movement between the lowered and raised positions.

30. The apparatus of claim 29 further comprising a first elastomeric bladder which extends between the frame and carriage and defines an interior chamber for receiving a gas for inflation and deflation of the first bladder;

wherein the carriage is movable relative to the frame in response to inflation of the first bladder.

31. An apparatus for traveling along a railway bed having first and second railroad rails, the apparatus comprising:

a frame;

a first set of rail engaging wheels mounted on the frame and adapted to ride on the first rail;

a second set of rail engaging wheels mounted on the frame and adapted to ride on the second rail;

a crawler adapted to support the frame for travel along the railway bed when one of the rails is removed from the railway bed;

a carriage which carries the crawler;

a lowered position of the carriage in which the crawler is adapted to contact the railway bed;

a raised position of the carriage in which the crawler is adapted to be out of contact with the railway bed;

a first pneumatic lift mounted on the frame for raising the carriage from the lowered position to the raised position; and a horizontal beam of the frame which has a top and a bottom; wherein the first pneumatic lift is seated atop and extends upwardly from the top of the horizontal beam of the frame.

32. The apparatus of claim 31 further comprising a horizontal beam of the carriage which has a top and a bottom; wherein the bottom of the horizontal beam of the carriage is above the top of the horizontal beam of the frame; and the first pneumatic lift is connected to and extends downwardly from the bottom of the horizontal beam of the carriage.

33. The apparatus of claim 32 further comprising first and second uprights of the carriage rigidly secured to and extending downwardly from the horizontal beam of the carriage; and wherein the first pneumatic lift is between the first and second uprights.

34. The apparatus of claim 33 further comprising a first vertically elongated through opening formed in the first upright; and a second vertically elongated through opening formed in the second upright; and wherein the horizontal beam of the frame passes through the first and second through openings so that the carriage is vertically slidable relative to the horizontal beam of the frame with the horizontal beam of the frame within the first and second vertically elongated through openings.

35. The apparatus of claim 31 further comprising a second pneumatic lift connected to and extending downwardly from the bottom of the horizontal beam for supporting the frame on the carriage.

36. An apparatus for traveling along a railway bed having first and second railroad rails, the apparatus comprising:

a frame;

a first set of rail engaging wheels mounted on the frame and adapted to ride on the first rail;

a second set of rail engaging wheels mounted on the frame and adapted to ride on the second rail;

a crawler adapted to support the frame for travel along the railway bed when one of the rails is removed from the railway bed;

a carriage which carries the crawler;

a lowered position of the carriage in which the crawler is adapted to contact the railway bed;

a raised position of the carriage in which the crawler is adapted to be out of contact with the railway bed;

a first pneumatic lift mounted on the frame for raising the carriage from the lowered position to the raised position; and a first air spring on the first pneumatic lift having a lower end seated on the frame and an upper end mounted on the carriage; wherein the first air spring comprises an elastomeric bladder defining an interior chamber for receiving a gas for inflation and deflation of the bladder.

37. An apparatus for traveling along a railway bed having first and second railroad rails, the apparatus comprising:

a frame;

a first set of rail engaging wheels mounted on the frame and adapted to ride on the first rail;

a second set of rail engaging wheels mounted on the frame and adapted to ride on the second rail;

a crawler adapted to support the frame for travel along the railway bed when one of the rails is removed from the railway bed;

a carriage which carries the crawler;

a lowered position of the carriage in which the crawler is adapted to contact the railway bed;

a raised position of the carriage in which the crawler is adapted to be out of contact with the railway bed;

a first pneumatic lift mounted on the frame for raising the carriage from the lowered position to the raised position;

a second pneumatic lift mounted on the carriage for supporting the frame on the carriage; and a portion of the first lift which is directly above the second lift in the lowered and raised positions.

38. An apparatus for traveling along a railway bed having first and second railroad rails, the apparatus comprising:

a frame;

a first set of rail engaging wheels mounted on the frame and adapted to ride on the first rail;

a second set of rail engaging wheels mounted on the frame and adapted to ride on the second rail;

a crawler adapted to support the frame for travel along the railway bed when one of the rails is removed from the railway bed;

a carriage which carries the crawler;

a lowered position of the carriage in which the crawler is adapted to contact the railway bed;

a raised position of the carriage in which the crawler is adapted to be out of contact with the railway bed;

a first pneumatic lift mounted on the frame for raising the carriage from the lowered position to the raised position;

a second pneumatic lift mounted on the carriage for supporting the frame on the carriage; wherein the second pneumatic lift is directly above the crawler in the lowered and raised positions.

39. An apparatus for traveling along a railway bed having first and second railroad rails, the apparatus comprising:

a frame;

a first set of rail engaging wheels mounted on the frame and adapted to ride on the first rail;

a second set of rail engaging wheels mounted on the frame and adapted to ride on the second rail;

a crawler adapted to support the frame for travel along the railway bed when one of the rails is removed from the railway bed;

a carriage which carries the crawler;

a lowered position of the carriage in which the crawler is adapted to contact the railway bed;

a raised position of the carriage in which the crawler is adapted to be out of contact with the railway bed;

a first pneumatic lift mounted on the frame for raising the carriage from the lowered position to the raised position;

a second pneumatic lift mounted on the carriage for supporting the frame on the carriage; and upper and lower ends on the second pneumatic lift; and wherein the upper end is directly above the lower end in the lowered and raised positions.

40. An apparatus for traveling along a railway bed having first and second railroad rails, the apparatus comprising:

a frame;

a first set of rail engaging wheels mounted on the frame and adapted to ride on the first rail;

a second set of rail engaging wheels mounted on the frame and adapted to ride on the second rail;

a crawler adapted to support the frame for travel along the railway bed when one of the rails is removed from the railway bed;

a carriage which carries the crawler;

a lowered position of the carriage in which the crawler is adapted to contact the railway bed;

a raised position of the carriage in which the crawler is adapted to be out of contact with the railway bed;

a first pneumatic lift mounted on the frame for raising the carriage from the lowered position to the raised position; and a second pneumatic lift mounted on the carriage for supporting the frame on the carriage; wherein the second pneumatic lift comprises an elastomeric bladder defining an interior chamber for receiving a gas for inflation and deflation of the bladder.

41. An apparatus for traveling along a railway bed having first and second railroad rails, the apparatus comprising:

a frame;

a first set of rail engaging wheels mounted on the frame and adapted to ride on the first rail;

a second set of rail engaging wheels mounted on the frame and adapted to ride on the second rail;

a crawler;

a carriage which carries the crawler;

a lowered position of the carriage in which the crawler is adapted to contact the railway bed;

a raised position of the carriage in which the crawler is adapted to be out of contact with the railway bed;

a first upright of the carriage which is vertical in the lowered and raised positions;

a sliding engagement between the first upright of the carriage and the frame during movement between the lowered and raised positions;

front and rear ends on the frame defining therebetween a longitudinal direction in which the apparatus travels on its wheels;

a longitudinal beam of the frame; and wherein the sliding engagement is between the first upright of the carriage and the longitudinal beam of the frame;

front and rear ends on the first upright;

a first vertically elongated through opening formed in the first upright from the front end of the first upright to the rear end of the first upright; and wherein the longitudinal beam of the frame passes through the first through opening so that the carriage is vertically slidable relative to the longitudinal beam with the longitudinal beam within the first vertically elongated through opening.

42. The apparatus of claim 41 further comprising a first lift seated atop and extending upwardly from the longitudinal beam for raising the carriage from the lowered position to the raised position.

43. The apparatus of claim 42 further comprising a second lift connected to and extending downwardly from the longitudinal beam for supporting the frame on the carriage in the lowered position.

44. An apparatus for traveling along a railway bed having first and second railroad rails, the apparatus comprising:

a frame;

a first set of rail engaging wheels mounted on the frame and adapted to ride on the first rail;

a second set of rail engaging wheels mounted on the frame and adapted to ride on the second rail;

a crawler;

a carriage which carries the crawler;

a lowered position of the carriage in which the crawler is adapted to contact the railway bed;

a raised position of the carriage in which the crawler is adapted to be out of contact with the railway bed;

a first upright of the carriage which is vertical in the lowered and raised positions;

a sliding engagement between the first upright of the carriage and the frame during movement between the lowered and raised positions; and a first pneumatic lift mounted on the frame for raising the carriage from the lowered position to the raised position; wherein the first pneumatic lift comprises an elastomeric bladder defining an interior chamber for receiving a gas for inflation and deflation of the bladder.

* * * * *